US010437191B2

(12) United States Patent
Kwon et al.

(10) Patent No.: US 10,437,191 B2
(45) Date of Patent: Oct. 8, 2019

(54) IMAGE FORMING APPARATUS

(71) Applicant: HP PRINTING KOREA CO., LTD., Suwon-si, Gyeonggi-do (KR)

(72) Inventors: Myung Sik Kwon, Suwon-si (KR); Leonid Chechurin, Hwaseong-si (KR); Jung Hyeon Kim, Hwaseong-si (KR); Yury Telegin, Suwon-si (KR); Dong Ho Kim, Suwon-si (KR)

(73) Assignee: HP PRINTING KOREA CO., LTD., Suwon-si (KR)

( * ) Notice: Subject to any disclaimer, the term of this patent is extended or adjusted under 35 U.S.C. 154(b) by 0 days.

(21) Appl. No.: 15/111,985

(22) PCT Filed: Jan. 15, 2015

(86) PCT No.: PCT/KR2015/000435
§ 371 (c)(1),
(2) Date: Jul. 15, 2016

(87) PCT Pub. No.: WO2015/108351
PCT Pub. Date: Jul. 23, 2015

(65) Prior Publication Data

US 2016/0342123 A1 Nov. 24, 2016

(30) Foreign Application Priority Data

Jan. 15, 2014 (KR) ..... 10-2014-0004987

(51) Int. Cl.
*G03G 15/00* (2006.01)
*G03G 21/16* (2006.01)

(52) U.S. Cl.
CPC ..... *G03G 15/6502* (2013.01); *G03G 15/6505* (2013.01); *G03G 21/1695* (2013.01); *G03G 21/1614* (2013.01); *G03G 2221/1654* (2013.01)

(58) Field of Classification Search
CPC ..... G03G 15/6502
(Continued)

(56) References Cited

U.S. PATENT DOCUMENTS 5,419,544 A * 5/1995 Ono ..... B65H 1/04 271/157
5,711,517 A * 1/1998 Kelly ..... B41J 13/103 271/162
(Continued)

FOREIGN PATENT DOCUMENTS

CN 1891597 A 1/2007
CN 100410158 C 8/2008
(Continued)

OTHER PUBLICATIONS

International Search Report (Form PCT/ISA/210); dated Apr. 24, 2015 in corresponding International Patent Application No. PCT/KR2015/000435 (3 pages) (2 pages English Translation).
(Continued)

*Primary Examiner* — Anthony H Nguyen
(74) *Attorney, Agent, or Firm* — Staas & Halsey LLP

(57) ABSTRACT

Disclosed herein is an image forming apparatus having a structure improved such that a user easily opens and closes a printing media cassette. The image forming apparatus includes an apparatus body, a printing media cassette to receive printing media, the printing media cassette being movably coupled to the apparatus body, and at least one lever movably disposed in the apparatus body, the lever contacting the printing media cassette to pull the printing media cassette into the apparatus body and then being separated from the printing media cassette when the printing media cassette is closed.

27 Claims, 45 Drawing Sheets

(58) Field of Classification Search
USPC ..... 399/393
See application file for complete search history.

(56) References Cited

U.S. PATENT DOCUMENTS

| | | | | |
|---|---|---|---|---|
| 5,926,671 | A * | 7/1999 | Leibman | E05C 1/145 312/333 |
| 7,543,812 | B2 * | 6/2009 | Underwood | B65H 1/266 271/145 |
| 7,546,061 | B2 * | 6/2009 | Kurokawa | B41J 13/103 101/494 |
| 7,712,988 | B2 * | 5/2010 | Hattori | B65H 1/266 271/145 |
| 8,428,506 | B2 * | 4/2013 | Miki | G03G 15/6502 292/341.13 |
| 9,008,565 | B2 * | 4/2015 | Taniguchi | G03G 15/6505 271/145 |
| 2005/0230903 | A1 * | 10/2005 | Lin | B41J 13/103 271/118 |
| 2005/0285330 | A1 * | 12/2005 | Tazika | B41J 13/103 271/157 |
| 2006/0180996 | A1 * | 8/2006 | Iwase | G03G 15/6502 271/162 |
| 2006/0209104 | A1 | 9/2006 | Naruse | |
| 2006/0237898 | A1 * | 10/2006 | Mizobe | B65H 1/14 271/147 |
| 2007/0001370 | A1 * | 1/2007 | Konishi | B65H 1/12 271/10.11 |
| 2007/0217844 | A1 * | 9/2007 | Yasuhara | G03G 15/6505 399/393 |
| 2008/0180764 | A1 * | 7/2008 | Wakiyama | G03G 15/6502 358/498 |
| 2009/0315254 | A1 * | 12/2009 | Shirasaki | G03G 21/1647 271/164 |
| 2013/0032996 | A1 * | 2/2013 | Kubota | B65H 1/266 271/264 |
| 2013/0285317 | A1 * | 10/2013 | Ishikura | B65H 9/08 271/241 |

FOREIGN PATENT DOCUMENTS

| | | |
|---|---|---|
| EP | 0561544 | 9/1993 |
| JP | H05155125 A | 6/1993 |
| JP | 2006-256210 A | 9/2006 |
| KR | 2019940013299 | 6/1994 |
| KR | 2019940013299 U | 6/1994 |
| KR | 10-20070052466 | 5/2007 |
| KR | 1020070052466 | 5/2007 |
| KR | 1020090036956 | 4/2009 |
| WO | WO 2015/108351 A1 | 7/2015 |

OTHER PUBLICATIONS

Written Opinion of the International Searching Authority (Form PCT/ISA/237); dated Apr. 24, 2015 in corresponding International Patent Application No. PCT/KR2015/000435 (8 pages) (11 pages English Translation).

* cited by examiner

100

IMAGE FORMING APPARATUS

CROSS-REFERENCE TO RELATED APPLICATIONS

This application is a U.S. national stage application of PCT international application PCT/KR2015/000435, filed on Jan. 15, 2015 and claims the benefits of Korean Patent Application No. 10-2014-0004987, filed on Jan. 15, 2014, respectively, the contents of which are incorporated herein by reference.

TECHNICAL FIELD

Embodiments of the present invention relate to an image forming apparatus with an improved opening and closing structure of a printing media cassette to receive printing media.

BACKGROUND ART

An image forming apparatus is an apparatus to print an image on printing media. The image forming apparatus includes a printer, copier, facsimile, and a multifunction device having functions of the printer, copier, and facsimile.

The image forming apparatus includes a printing media cassette to supply printing media to a printing device provided therein.

Generally, the printing media cassette is openably and closably mounted in an apparatus body of the image forming apparatus.

DISCLOSURE

Technical Problem

In a case in which it takes excessive force to open the printing media cassette in a state in which the printing media cassette is closed, emotional quality of products is deteriorated. When a user pulls the printing media cassette by force, the printing media cassette may be damaged or the user may be injured.

Technical Solution

It is an aspect of the present invention to provide an image forming apparatus having a structure improved such that a user easily opens and closes a printing media cassette.

Additional aspects of the invention will be set forth in part in the description which follows and, in part, will be obvious from the description, or may be learned by practice of the invention.

In accordance with one aspect of the present invention, an image forming apparatus includes an apparatus body, a printing media cassette to receive printing media, the printing media cassette being movably coupled to the apparatus body, and at least one lever movably disposed in the apparatus body, the lever contacting the printing media cassette to pull the printing media cassette into the apparatus body and then being separated from the printing media cassette when the printing media cassette is closed.

The lever may be slidably disposed along a movement path provided in the apparatus body.

When the printing media cassette is closed, the lever may be pushed by the printing media cassette and then push the printing media cassette.

When the printing media cassette is opened, the printing media cassette may move in a state in which the printing media cassette is separated from the lever and then contact the lever to push the lever.

The printing media cassette may include a first catching part pushed by the lever when the printing media cassette is closed and a second catching part pushing the lever when the printing media cassette is opened.

The printing media cassette may further include a guide part pushing the lever to guide the lever to the first catching part when the printing media cassette is closed.

The printing media cassette may further include a lever receiving part receiving at least a portion of the lever when the printing media cassette is closed.

The image forming apparatus may further include an elastic member disposed between the apparatus body and the lever to elastically bias the lever.

The image forming apparatus may further include a fixing plate fixed in the apparatus body and a guide plate extending from the fixing plate toward the printing media cassette, the guide plate including a guide slot to guide the lever.

The guide slot may include a parallel part parallel to a movement direction of the printing media cassette and a first inclined part and a second inclined part inclined from the parallel part.

The first inclined part may be perpendicular to the parallel part.

When the printing media cassette is closed, the lever may push the printing media cassette after the lever enters the parallel part.

The lever may include a catching pin contacting the printing media cassette when the printing media cassette is closed or opened and a support pin coupled to the catching pin via the guide plate, the support pin having a first support hole to support one end of the elastic member.

The fixing plate may include a support protrusion having a second support hole to support the other end of the elastic member.

The image forming apparatus may further include a fixing plate fixed in the apparatus body, a guide plate extending from the fixing plate toward the printing media cassette, the guide plate having a first guide slot to guide the lever, and a slider slidably coupled to the guide plate, the slider having a second guide slot to guide the lever.

The second guide slot may be perpendicular to the movement direction of the printing media cassette.

The image forming apparatus may further include at least one elastic member disposed between the fixing plate and the slider to elastically bias the slider.

The image forming apparatus may further include a connection lever movably coupled to the slider, the connection lever being connected to the printing media cassette when the printing media cassette is opened.

The connection lever may include a first catching part contacting the printing media cassette and pushed by the printing media cassette when the printing media cassette is opened and a second catching protrusion received in the slider to push the slider when the printing media cassette is opened.

The image forming apparatus may further include a first elastic member disposed between the fixing plate and the lever to elastically bias the lever and a second elastic member disposed between the fixing plate and the connection lever to elastically bias the connection lever.

In accordance with another aspect of the present invention, an image forming apparatus includes an apparatus body, a printing media cassette to receive printing media, the printing media cassette being movably coupled to the apparatus body, and a lever movably disposed in the apparatus body, wherein, when the printing media cassette is opened, the printing media cassette moves in a state in which the printing media cassette is separated from the lever and then contacts the lever to push the lever.

In accordance with another aspect of the present invention, an image forming apparatus includes an apparatus body, a printing media cassette to receive printing media, the printing media cassette being movably coupled to the apparatus body, and an opening and closing device pulling the printing media cassette into the apparatus body when the printing media cassette is closed, wherein the opening and closing device includes a first catching part and a second catching part provided at the printing media cassette, the first catching part and the second catching part being spaced apart from each other, and a lever movably provided in the apparatus body, the lever contacting one of the first and second catching parts when the printing media cassette is opened and contacting the other of the first and second catching parts when the printing media cassette is closed.

The opening and closing device may further include a guide part connected to the first catching part, the guide part being inclined from a movement direction of the printing media cassette.

The lever may be located at a first position in a state in which the printing media cassette is open and at a second position different from the first position in a state in which the printing media cassette is closed.

In a state in which the lever is located at the first position, the lever may be located outside a movement path of the second catching part such that the lever does not interfere with the second catching part.

In a state in which the lever is located at the second position, the lever may be located outside a movement path of the first catching part such that the lever does not interfere with the first catching part.

In accordance with a further aspect of the present invention, an image forming apparatus includes an apparatus body, a printing media cassette to receive printing media, the printing media cassette being movably coupled to the apparatus body, a first lever provided at the printing media cassette, a second lever provided in the apparatus body, and at least one elastic member provided in the apparatus body to elastically bias the second lever, wherein, when the printing media cassette is closed, the second lever pushes the first lever while sliding due to elastic force of the elastic member to pull the printing media cassette into the apparatus body and is then disposed such that the second lever does not interfere with the first lever, and, when the printing media cassette is opened, the first lever moves through a predetermined initial section without interference with the second lever, pushes the second lever to slide the second lever, and is then separated from the second lever.

Advantageous Effects

As is apparent from the above description, according to the embodiment of the present invention, the user may easily open and close the printing media cassette, thereby improving emotional quality of products and convenience in using the products.

DESCRIPTION OF DRAWINGS

These and/or other aspects of the invention will become apparent and more readily appreciated from the following description of the embodiments, taken in conjunction with the accompanying drawings of which.

MODES OF THE INVENTION

Figure 1:
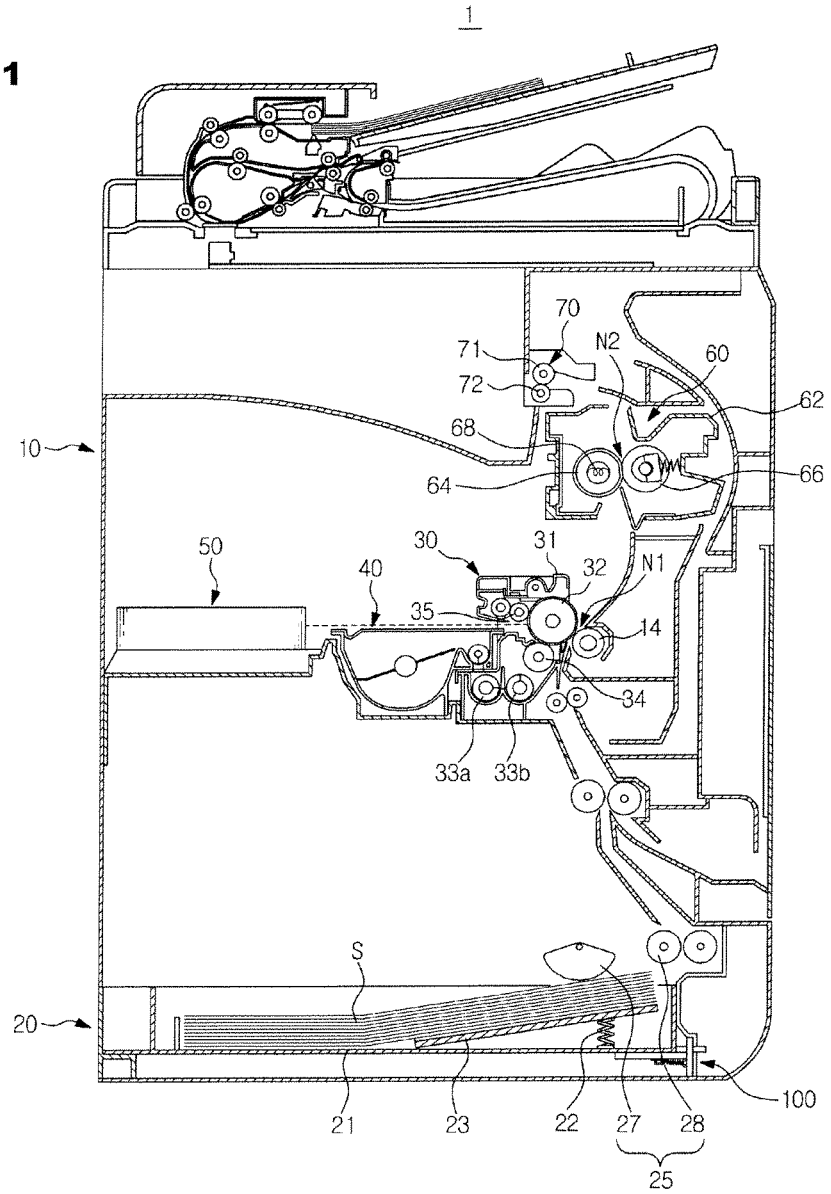
FIG. 1 is a view showing the construction of an image forming apparatus according to an embodiment of the present invention.

Reference will now be made in detail to the embodiments of the present invention, examples of which are illustrated in the accompanying drawings, wherein like reference numerals refer to like elements throughout.

Figure 2:
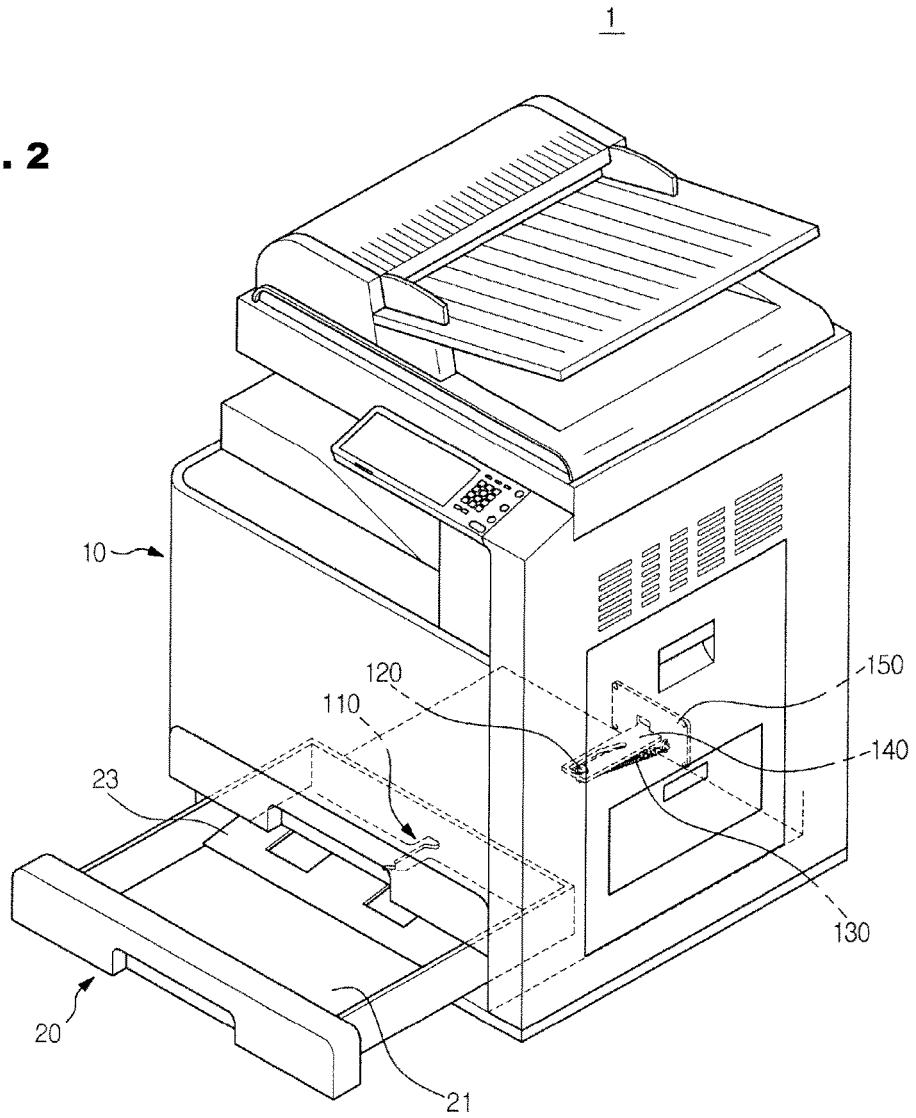
FIG. 2 is a perspective view of the image forming apparatus according to the embodiment of the present invention.

FIG. 1 is a view schematically showing the construction of an image forming apparatus according to an embodiment of the present invention and FIG. 2 is a perspective view of the image forming apparatus according to the embodiment of the present invention.

As shown in FIGS. 1 and 2, the image forming apparatus 1 includes an apparatus body 10, a printing media supply device 20 to store and supply printing media S, a developing device 30 to form an image on each printing medium S supplied by the printing media supply device 20, a toner device 40 to supply toner to the developing device 30, an optical scanning device 50 to form an electrostatic latent image on a photoconductor 32 of the developing device 30, a fusing device 60 to fuse a toner image transferred to each printing medium S on each printing medium S, and a discharge device 70 to discharge each printing medium S having the image finally formed thereon out of the apparatus body 10.

The printing media supply device 20 stores and supplies printing media S. The printing media supply device 20 is provided at the lower part of the apparatus body 10 to supply the printing media S to the developing device 30.

The printing media supply device 20 may include a printing media cassette 21 openably and closably coupled to the apparatus body 10 to store printing media S and a feeding member 25 to pick up the printing media S stored in the printing media cassette 21 one by one and to feed each picked-up printing medium S to the developing device 30.

In the printing media cassette 21 may be provided a knock up plate 23 having one end rotatably coupled to the printing media cassette 21 and the other end supported by a compression spring 22 such that the stored printing media S are guided to the feeding member 25.

The feeding member 25 may include a pickup roller 27 to pick up the printing media S loaded on the knock up plate 23 one by one and a feed roller 28 to feed each printing medium S picked-up by the pickup roller 27 to the developing device 30.

The developing device 30 includes a housing 31 forming the external appearance thereof, a photoconductor 32 rotatably coupled in the housing 31 to form an electrostatic latent image, agitating screws 33*a* and 33*b* to agitate toner supplied from the toner device 40, a developing roller 34 to supply the toner agitated by the agitating screws 33*a* and 33*b* to the photoconductor 32, and a charging member 35 to charge the photoconductor 32.

The toner supplied from the toner device 40 is introduced into the housing 31, fed to one side of the housing 31 while being agitated by the agitating screws 33*a* and 33*b*, and supplied to the photoconductor 32 via the developing roller 34 to form a visible image.

The photoconductor 32 contacts a transfer roller 14 to form a transfer nip N1 such that the toner supplied to the photoconductor 32 to form the visible image is transferred to each printing medium S. The transfer roller 14 may be rotatably disposed in the apparatus body 10.

The toner device 40 is coupled to the developing device 30. The toner device 40 stores toner to form an image on each printing medium S and supplies the toner to the developing device 30 when an image forming operation is performed.

The optical scanning device 50 scans light including image information to the photoconductor 32 to form an electrostatic latent image on the photoconductor 32.

The fusing device 60 includes a housing 62 and a heating member 64 and a pushing member 66 rotatably disposed in the housing 62.

Each printing medium S, to which the toner image has been transferred, passes through a space between the heating member 64 and the pushing member 66. At this time, the toner image is fixed to each printing medium S by heat and pressure.

The heating member 64 rotates while being engaged with the pushing member 66 to form a fusing nip N2 together with the pushing member 66. The heating member 64 is heated by a heat source 68 to transmit heat to each printing medium S passing through the fusing nip N2. The heating member 64 may be constituted by a heating roller rotatable by power from a drive source (not shown). The heat source 68 is disposed inside the heating member 64 to apply heat to each printing medium S, to which the toner has been transferred. A halogen lamp may be used as the heat source 68. Alternatively, an electric heating wire or an induction heater may be used.

The pushing member 66 is disposed in contact with the outer circumference of the heating member 64 to form the fusing nip N2 between the pushing member 66 and the heating member 64. The pushing member 66 may be constituted by a pushing roller rotatable by power from a drive source (not shown).

The discharge device 70 includes a first discharge roller 71 and a second discharge roller 72 which are engaged with each other. The discharge device 70 discharges each printing medium S having passed through the fusing device 60 out of the apparatus body 10.

At one side of the printing media supply device 20 in the apparatus body 10 is mounted an opening and closing device 100, 200, 300, or 400 which pulls the printing media cassette 21 into the apparatus body 10 when the printing media cassette 21 is closed.

Figure 3:
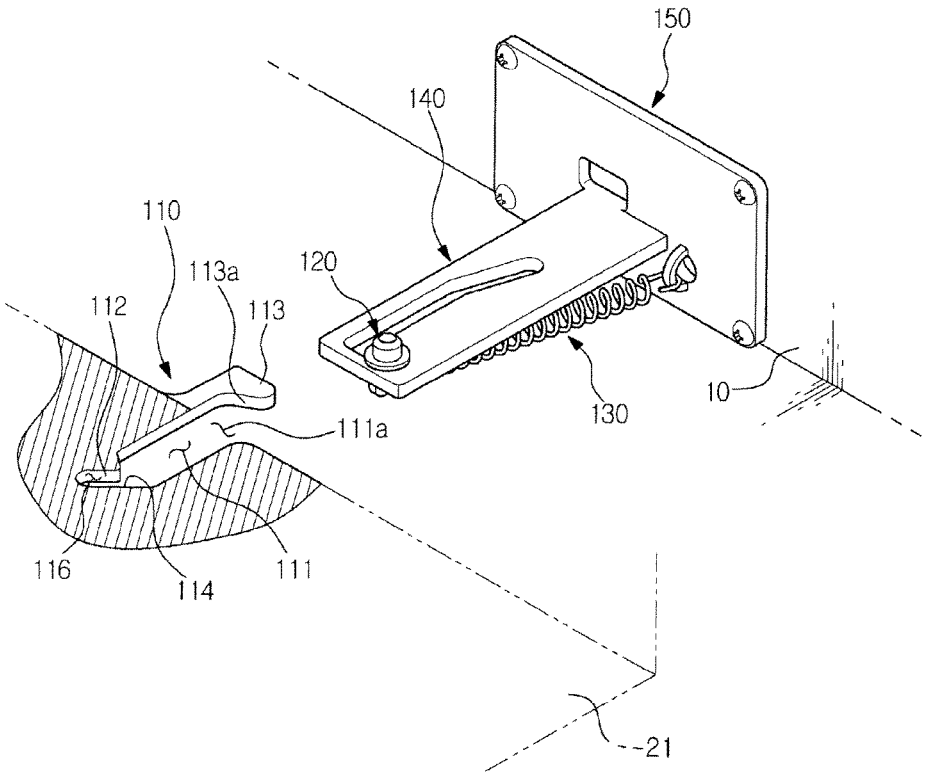
FIG. 3 is a perspective view showing an opening and closing device according to an embodiment of the present invention.
Figure 4:
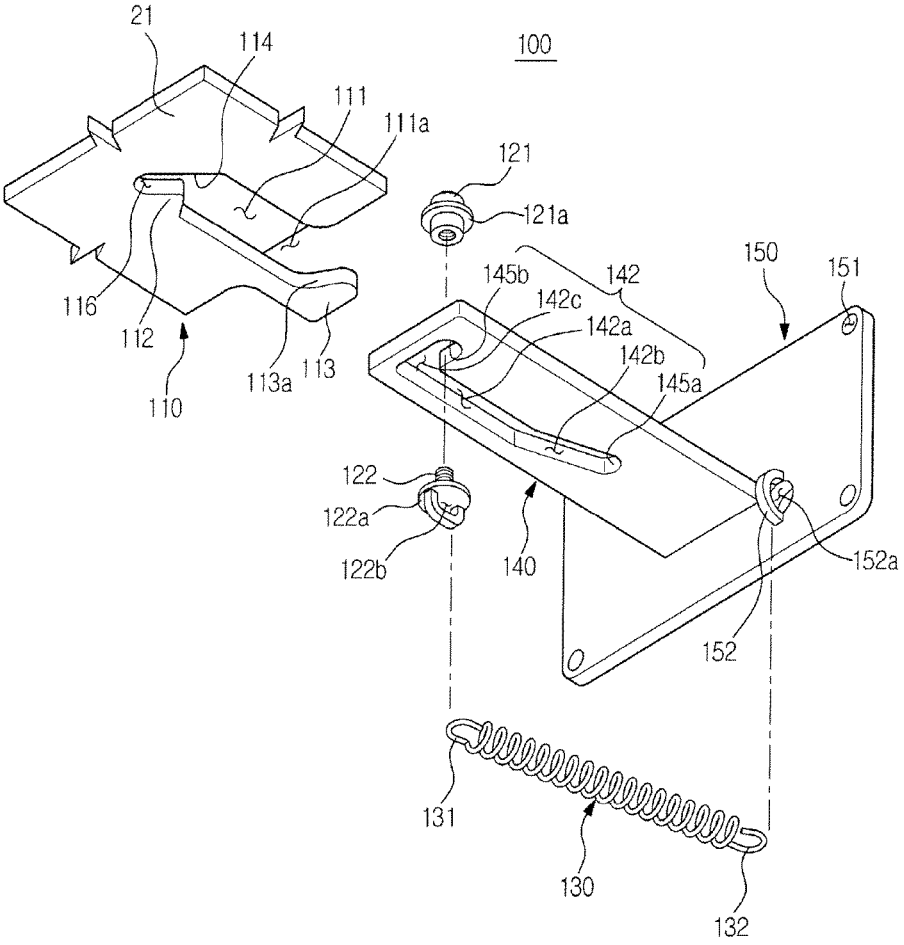
FIG. 4 is an exploded perspective view of the opening and closing device according to the embodiment of the present invention.

FIG. 3 is a perspective view showing an opening and closing device according to an embodiment of the present invention and FIG. 4 is an exploded perspective view of the opening and closing device according to the embodiment of the present invention.

As shown in FIGS. 2 to 4, the opening and closing device 100 includes a first lever 110 provided at the printing media cassette 21, a second lever 120 provided in the apparatus body 10, an elastic member 130 to elastically bias the second lever 120, a guide plate 140 to movably support the second lever 120, and a fixing plate 150 to support the elastic member 130 and the guide plate 140. The first lever 110 may be integrally formed with the printing media cassette 21.

The first lever 110 includes a lever receiving part 111 formed at a lower surface of the printing media cassette 21, a first catching part 112 protruding from an inner surface of the lever receiving part 111 toward the lever receiving part 111, a second catching part 113 protruding backward from a rear surface of the printing media cassette 21, and a guide part 114 connected to the first catching part 112, the guide part 114 being inclined from a movement direction of the printing media cassette 21.

One end of the lever receiving part 111 is opened to form an opening 111*a*, through which a portion of the second lever 120 is received and introduced into the inside of the lever receiving part 111 when the printing media cassette 21 is closed or opened.

When the printing media cassette 21 is closed, the first catching part 112 contacts the second lever 120 received in the lever receiving part 111 and is pushed by the second lever 120.

The second catching part 113 is spaced apart from the first catching part 112 in a direction in which the printing media cassette 21 is closed. When the printing media cassette 21 is opened, the second catching part 113 contacts the second lever 120 to push the second lever 120. The second catching part 113 includes a guide surface 113*a*. The guide surface 113*a* guides the second lever 120 to locate the second lever 120 at a second inclined part 142*c* of a guide slot 142 such that the second lever 120 is located at a first position, which is a standby position, when the second catching part 113 and the second lever 120 are separated from each other.

When the printing media cassette 21 is closed, the guide part 114 pushes the second lever 120. The second lever 120 is pushed by the guide part 114 and moves along the guide part 114 to contact the first catching part 112. At a connection between the guide part 114 and the first catching part 112 is formed a receiving groove 116 to receive the second lever 120, which has been moved while being pushed by the guide part 114. The second lever 120 pushes the first catching part 112 in a state in which the second lever 120 is received in the receiving groove 116.

The second lever 120 is movably disposed in the apparatus body 10. The second lever 120 includes a catching pin 121 contacting the first lever 110 when the printing media cassette 21 is closed or opened and a support pin 122 coupled and fixed to the catching pin 121 via the guide plate 140.

The catching pin 121 is disposed at an upper surface of the guide plate 140. The support pin 122 is disposed at a lower surface of the guide plate 140. The catching pin 121 includes a first flange 121*a*. The support pin 122 includes a second flange 122*a*. The first flange 121*a* and the second flange 122*a* prevent the second lever 120 from being separated from the guide slot 142 during movement of the second lever 120. The support pin 122 is provided with a first support hole 122*b*. One end 131 of the elastic member 130 is turnably supported by the support pin 122 through the first support hole 122*b*.

The elastic member 130 is disposed between the second lever 120 and the fixing plate 150 to elastically bias the second lever 120 such that the second lever 120 pushes the first lever 110 when the printing media cassette 21 is closed. The elastic member 130 may be constituted by a tension spring.

One end 131 of the elastic member 130 is turnably supported in the first support hole 122*b* provided at the support pin 122. The other end 132 of the elastic member 130 is turnably supported in a second support hole 152*a* provided at the fixing plate 150. One end 131 of the elastic member 130 may turn about the other end 132 of the elastic member 130.

The guide plate 140 includes a guide slot 142 to guide slide movement of the second lever 120. The guide slot 142 includes a parallel part 142*a* parallel to the movement direction of the printing media cassette 21, a first inclined part 142*b* inclined from the parallel part 142*a*, the first inclined part 142*b* being connected to one end of the parallel part 142*a*, and a second inclined part 142*c* inclined from the parallel part 142*a*, the second inclined part 142*c* being connected to the other end of the parallel part 142*a*. The second inclined part 142*c* may be perpendicular to the parallel part 142*a*.

When the printing media cassette 21 is closed or opened, the guide slot 142 guides movement of the second lever 120. When the printing media cassette 21 is closed, the second lever 120 is pushed by the guide part 114, is separated from the second inclined part 142*c*, and slides along the parallel part 142*a* and the first inclined part 142*b*. When the printing media cassette 21 is opened, on the other hand, the second lever 120 is pushed by the second catching part 113, slides along the first inclined part 142*b* and the parallel part 142*a*, and enters the second inclined part 142*c*.

The first inclined part 142*b* is provided at one end thereof with a first support part 145*a*. The second inclined part 142*c* is provided at one end thereof with a second support part 145*b*. When the printing media cassette 21 is closed, the first support part 145*a* contacts the second lever 120 to support the second lever 120 and restricts slide movement of the second lever 120 such that the second lever 120 is located at a second position, which is a closed position. When the printing media cassette 21 is opened, the second support part 145*b* contacts the second lever 120 to support the second lever 120 and restricts slide movement of the second lever 120 such that the second lever 120 is located at the first position, i.e. the standby position.

The guide plate 140 extends from the fixing plate 150 toward the printing media cassette 21.

The fixing plate 150 includes a plurality of fixing holes 151 to fix the fixing plate 150 in the apparatus body 10 and a support protrusion 152 to support the elastic member 130. The support protrusion 152 is provided with a second support hole 152*a*. The other end of the elastic member 130 is turnably supported by the support protrusion 152 through the second support hole 152*a*.

Hereinafter, a process of opening and closing the printing media cassette 21 will be described.

FIGS. 5A to 5G are views showing a process of closing the printing media cassette.

Figure 5A:
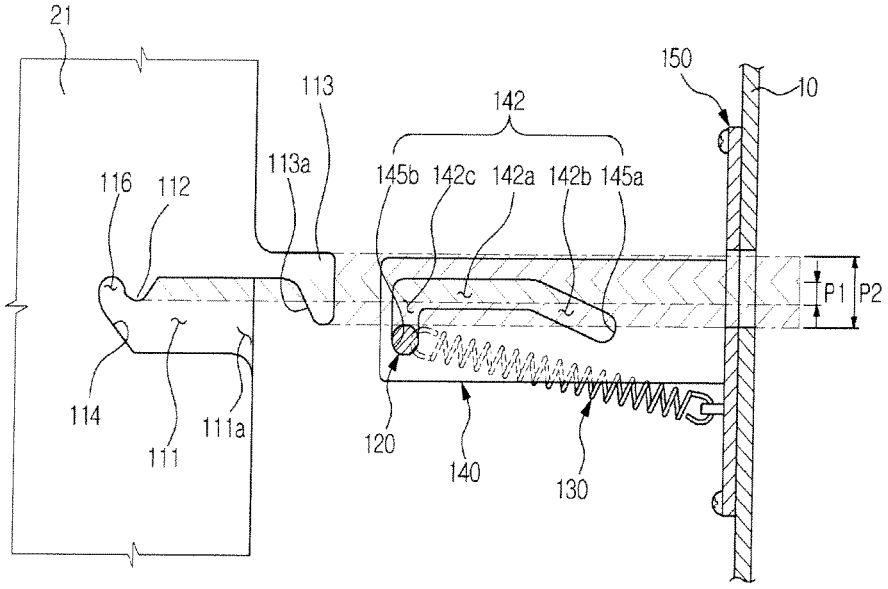
FIGS. 5A to 5G are views showing a process of closing a printing media cassette.
Figure 5B:
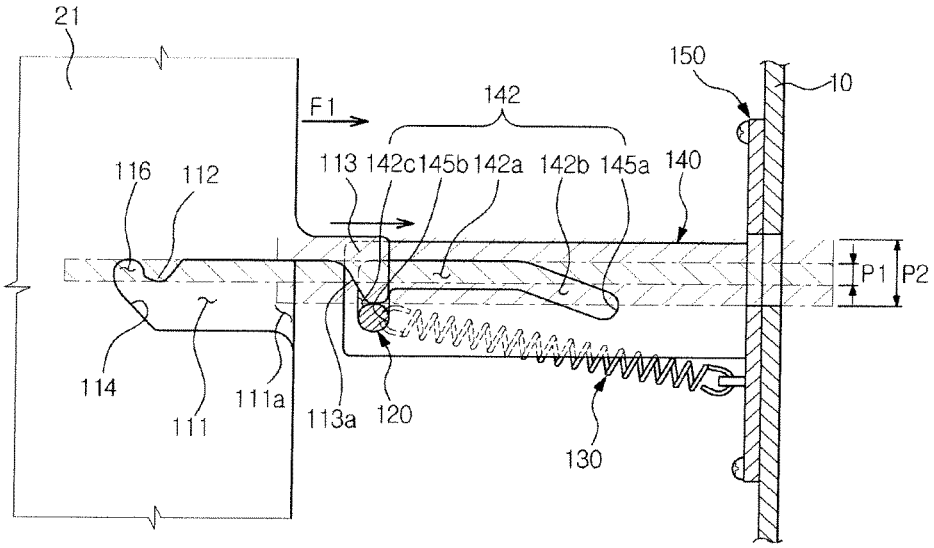
Figure 5C:
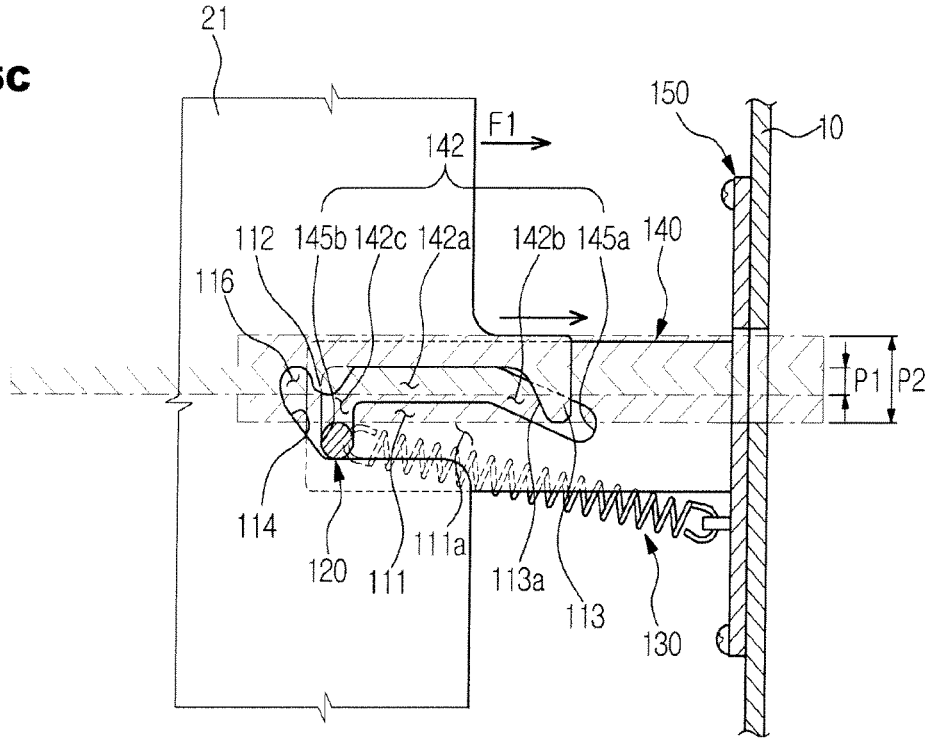
Figure 5D:
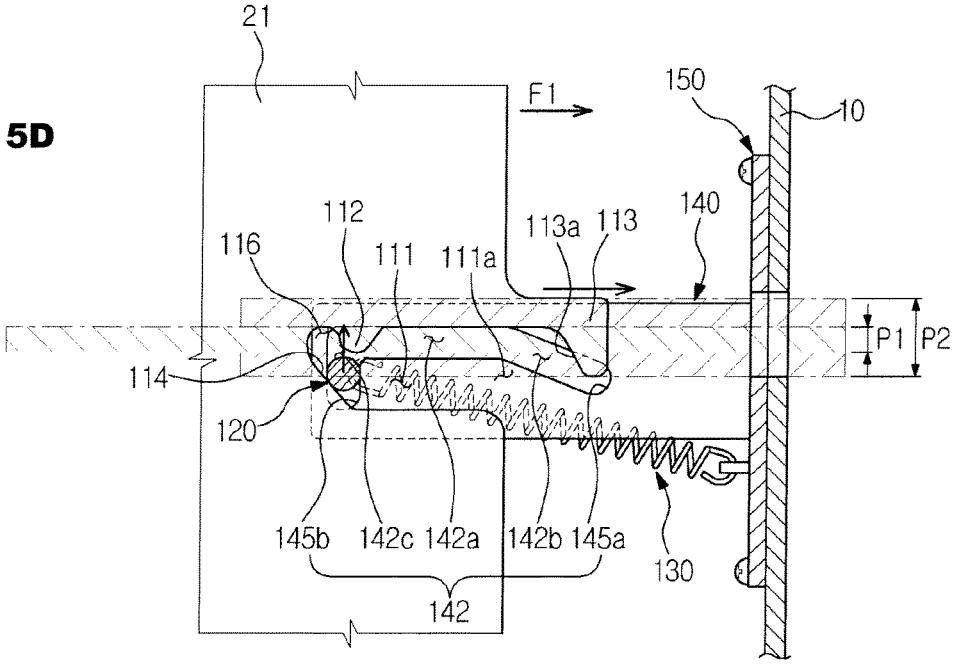
Figure 5E:
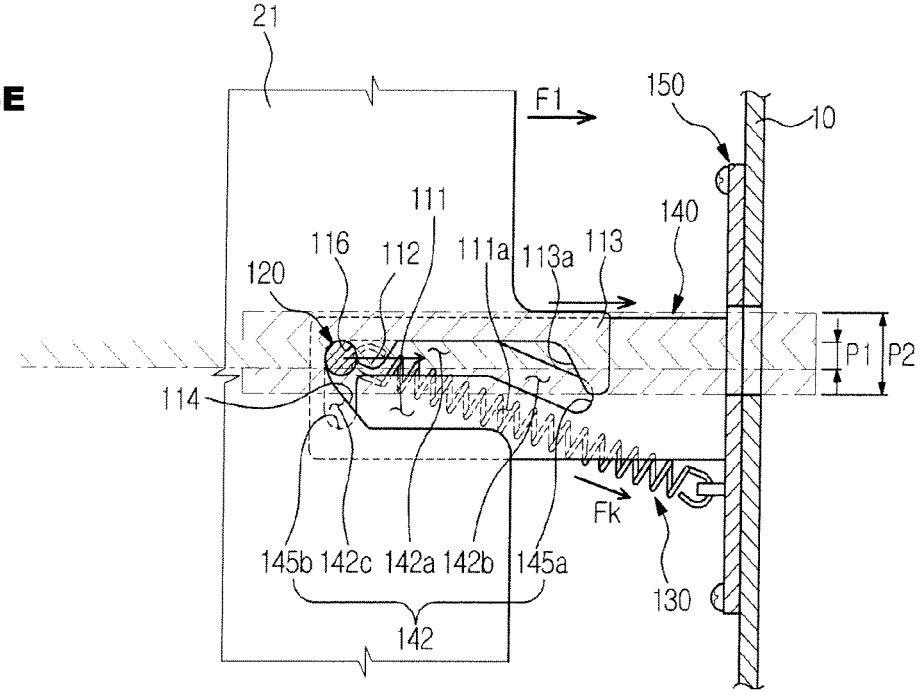

In a state in which the printing media cassette 21 is open, as shown in FIG. 5A, the second lever 120 of the opening and closing device 100 is located at the first position, i.e. the standby position. At this time, the second lever 120 is received in the second inclined part 142*c* of the guide slot 142 and is supported and stopped by the second support part 145*b*. In a state in which the second lever 120 is located at the first position, the second lever 120 is located outside a movement path P2 of the second catching part 113 such that the second lever 120 does not interfere with the second catching part 113.

When a user applies force F1 to the printing media cassette 21, as shown in FIGS. 5B to 5E, the printing media cassette 21 enters the apparatus body 10. The second lever 120 is pushed by the guide part 114, is separated from the second inclined part 142*c*, and enters the parallel part 142*a*. At this time, the second lever 120 is received in the receiving groove 116 of the first lever 110 and contacts the first catching part 112.

Figure 5F:
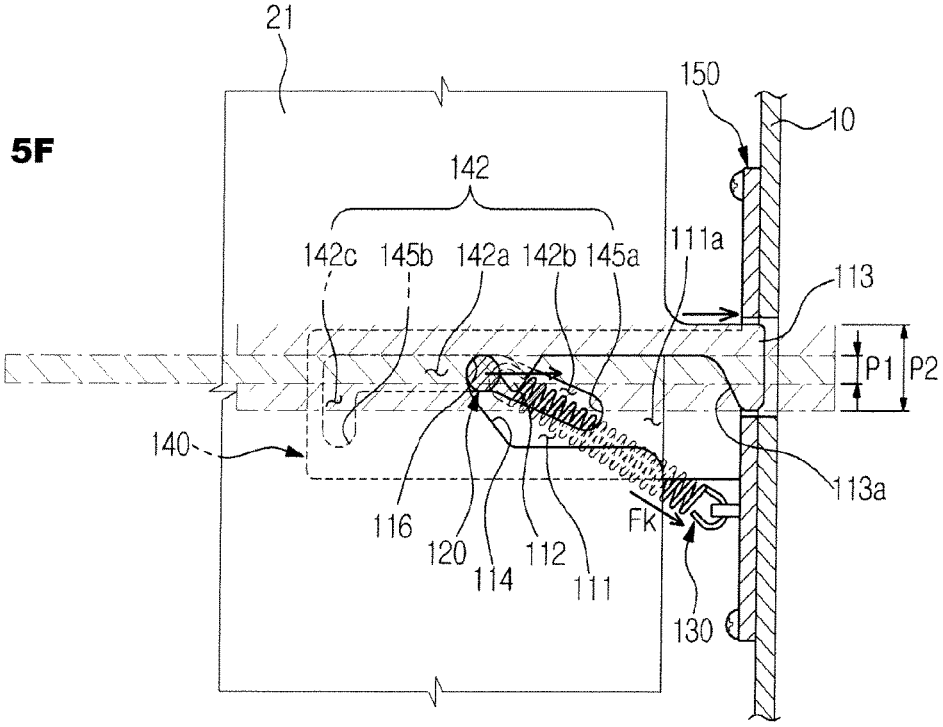

When the second lever 120 enters the parallel part 142*a*, as shown in FIG. 5F, the second lever 120 slides along the parallel part 142*a* and the first inclined part 142*b* due to elastic force Fk of the elastic member 130. During slide movement of the second lever 120 along the parallel part 142*a* and the first inclined part 142*b*, the second lever 120 pushes the first lever 110 via the first catching part 112 to pull the printing media cassette 21 into the apparatus body 10. Consequently, the user may easily close the printing media cassette 21 using low force.

Figure 5G:
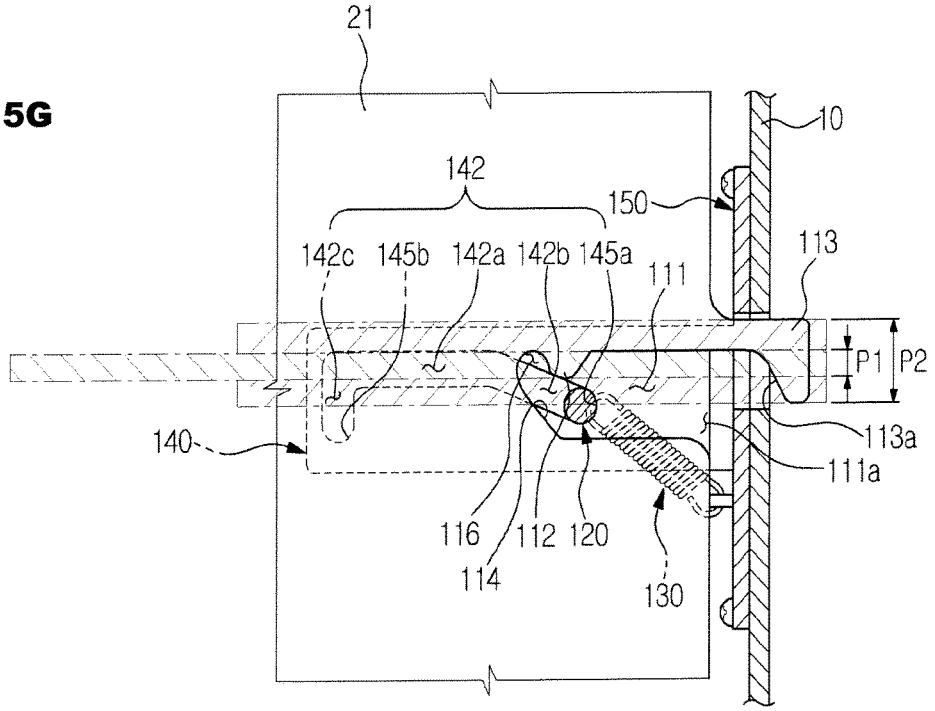

When the printing media cassette 21 is completely closed, as shown in FIG. 5G, the second lever 120 contacts the first support part 145*a* and is thus stopped and is located at the second position, i.e. the closed position. When the second lever 120 is stopped, the second lever 120 is separated from the first lever 110. That is, the second lever 120 is separated from the printing media cassette 21.

In a state in which the second lever 120 is located at the second position, the second lever 120 is located outside a movement path P1 of the first catching part 112 such that the second lever 120 does not interfere with the first catching part 112.

FIGS. 6A to 6H are views showing a process of opening the printing media cassette.

Figure 6A:
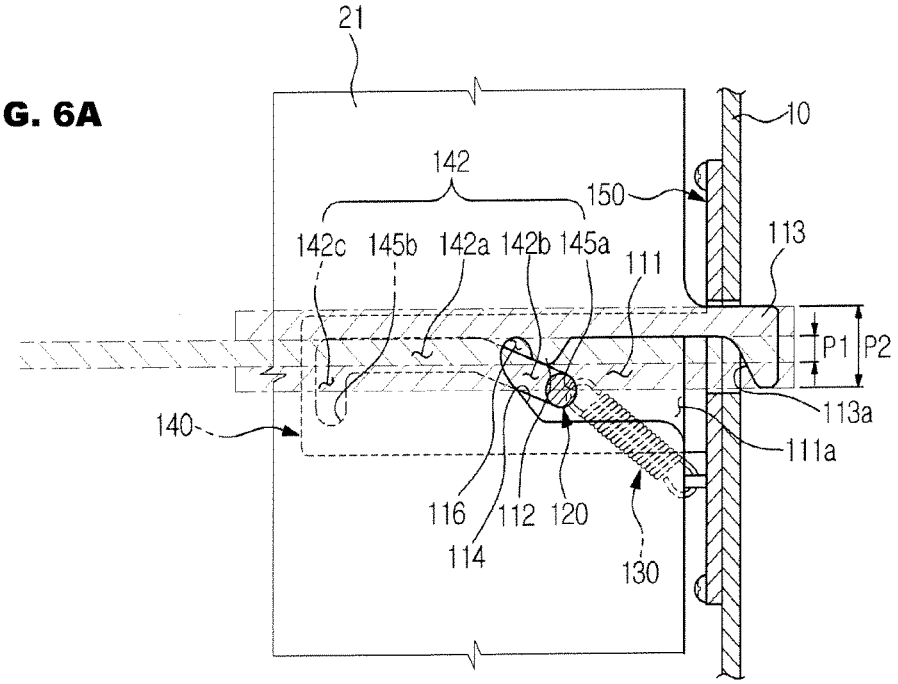
FIGS. 6A to 6H are views showing a process of opening the printing media cassette.
Figure 6B:
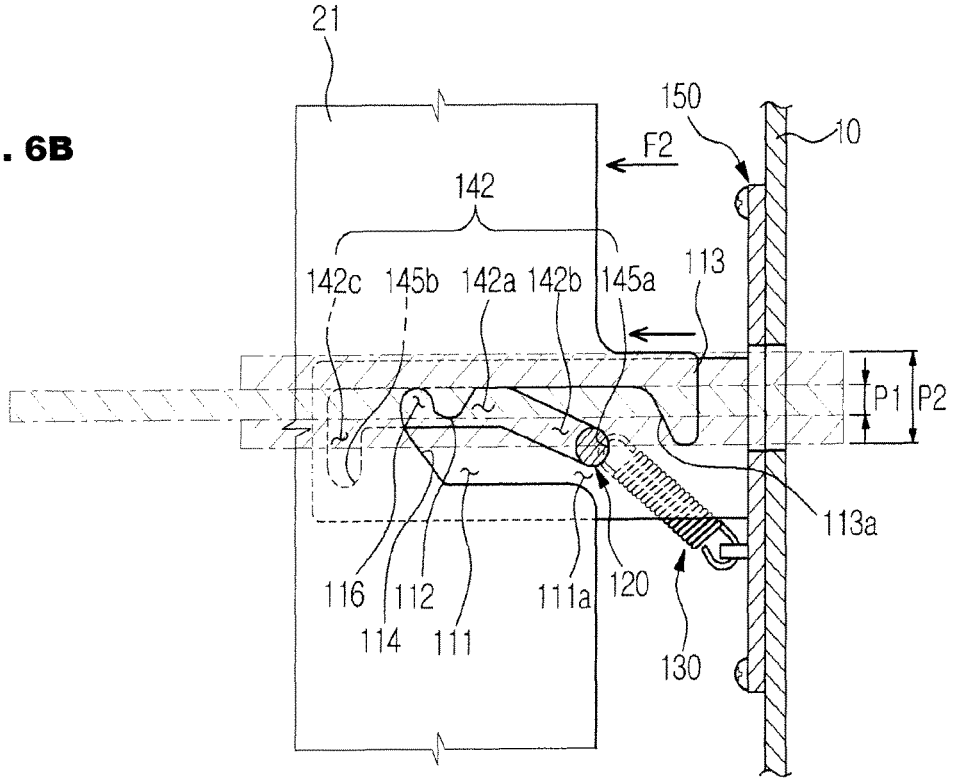

When the user applies force F2 to the printing media cassette 21 in a state in which the printing media cassette 21 is closed, as shown in FIGS. 6A and 6B, the printing media cassette 21 moves in a direction opposite to the direction in which the printing media cassette 21 enters the apparatus body 10. Since the second lever 120 is located outside the movement path P1 of the first catching part 112 such that the second lever 120 does not interfere with the first catching part 112, the second lever 120 is located and stopped at the second position. The printing media cassette 21 and the first lever 110 freely move without interference with the second lever 120. That is, any force from the opening and closing device 100 is not applied to the printing media cassette 21 excluding the force F2 applied by the user. Consequently, the user may pull the printing media cassette 21 from the apparatus body 10 using low force in a state in which the printing media cassette 21 is closed.

Figure 6C:
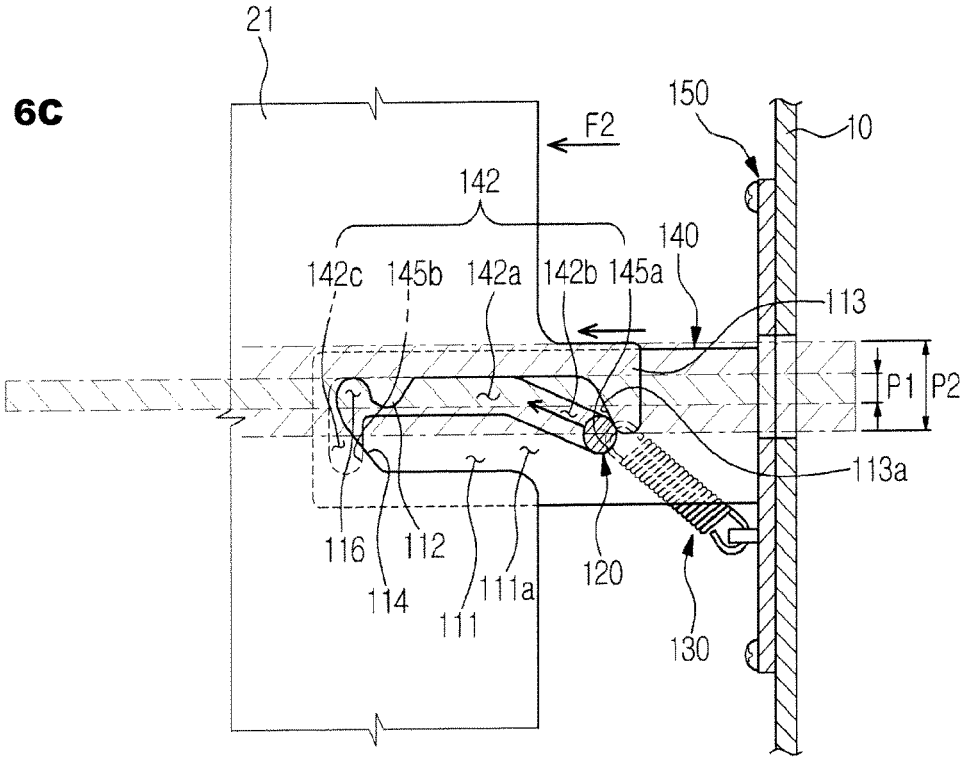
Figure 6D:
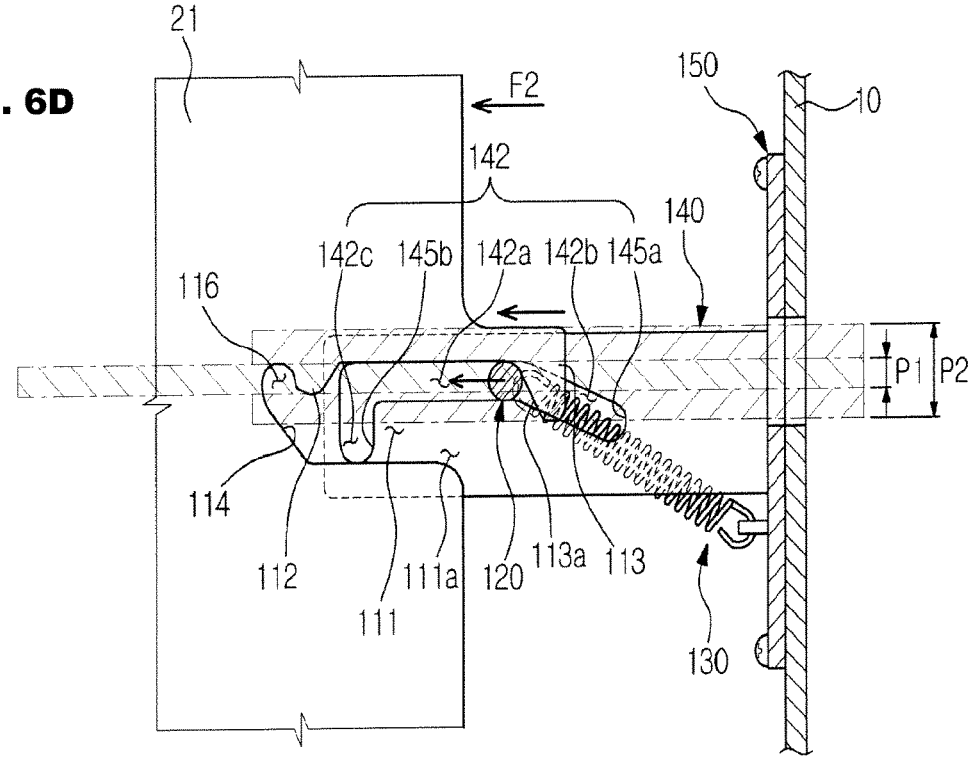
Figure 6E:
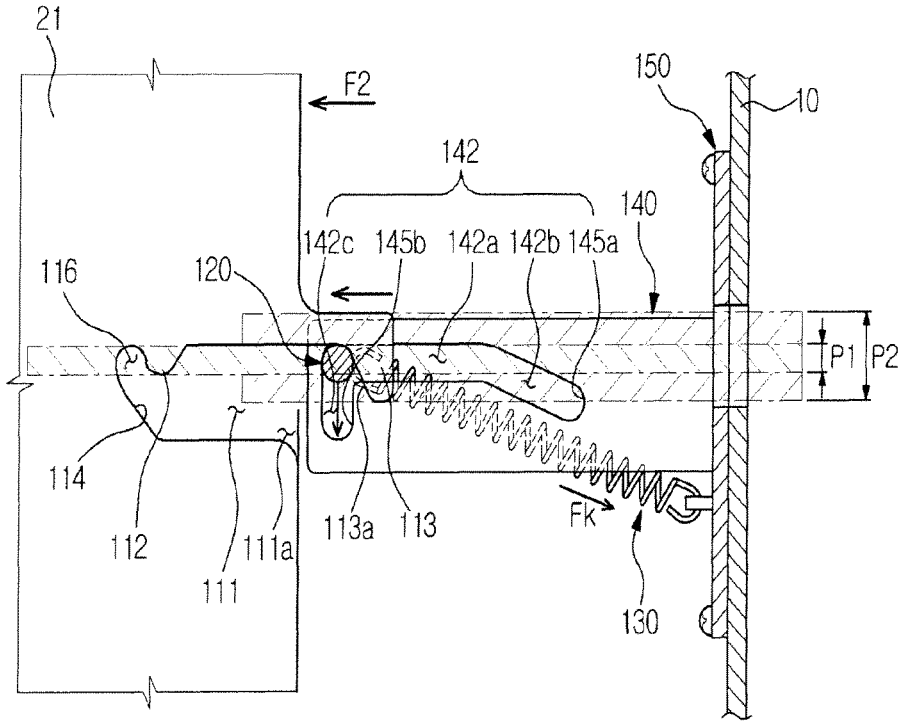
Figure 6F:
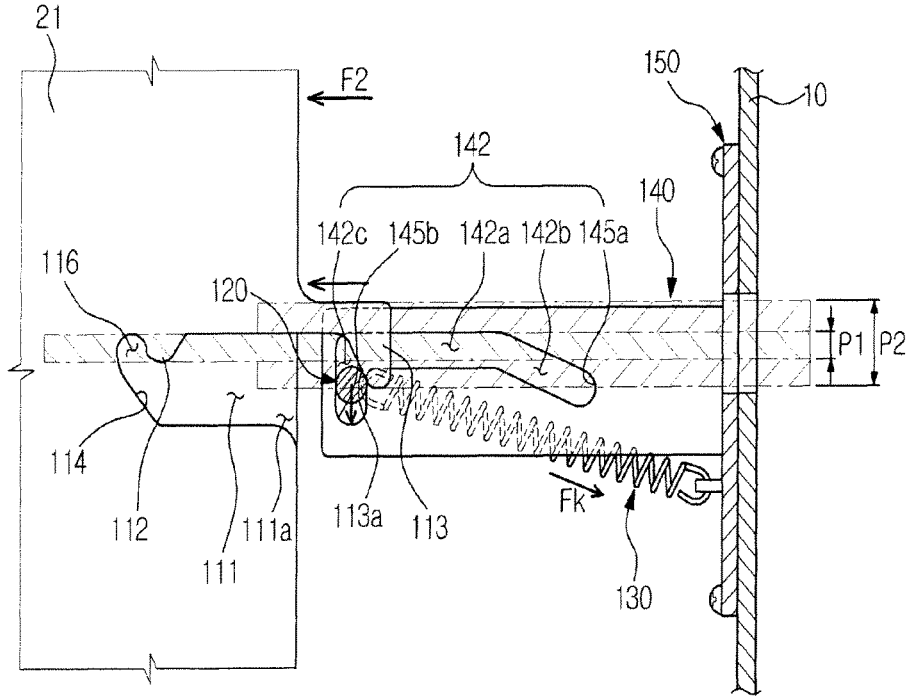
Figure 6G:
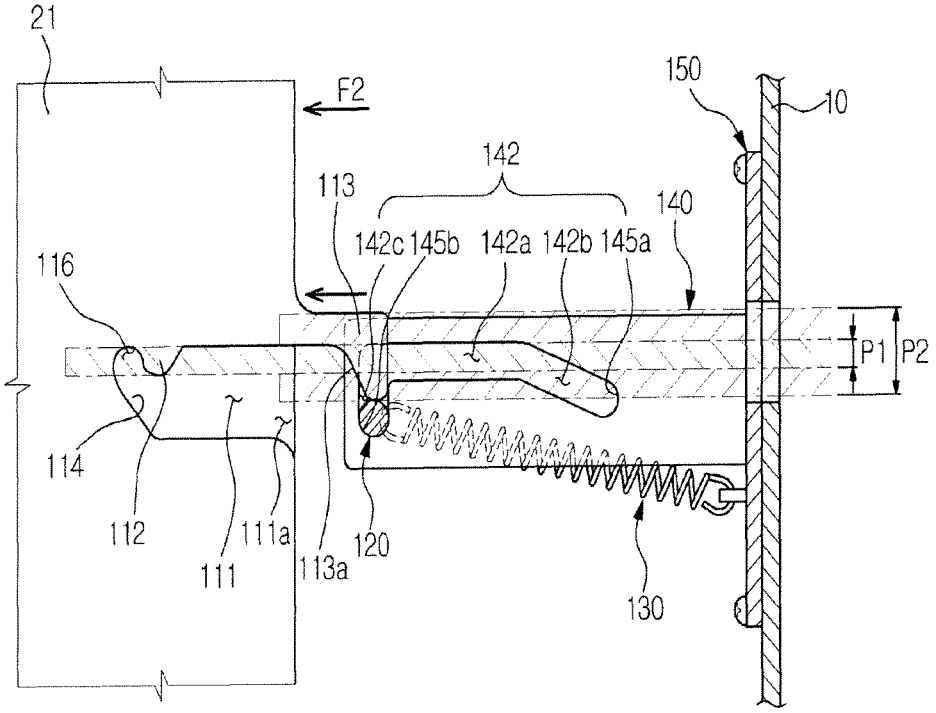
Figure 6H:
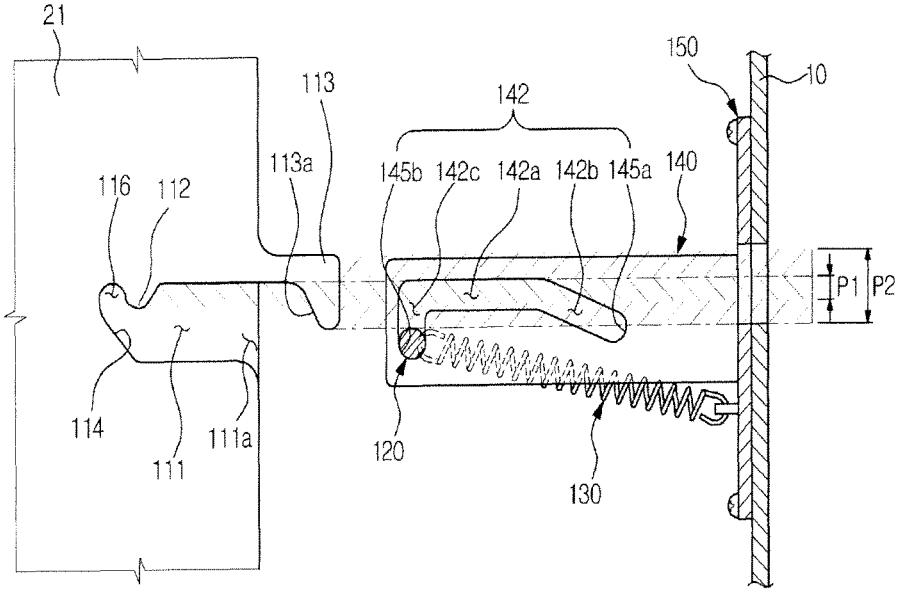

When the second catching part 113 of the first lever 110 contacts the second lever 120, as shown in FIGS. 6C and 6D, the second lever 120 is pushed by the second catching part 113 and slides along the first inclined part 142*b* and the parallel part 142*a*. The elastic member 130 is extended to accumulate elastic force. The second catching part 113 of the first lever 110 is accelerated until the second catching part 113 contacts the second lever 120. The accelerated second catching part 113 contacts the second lever 120 to push the second lever 120. Consequently, the user may pull the printing media cassette 21 using low force.

When the second lever 120 slides along the first inclined part 142*b* and the parallel part 142*a* and reaches the end of the parallel part 142*a*, as shown in FIGS. 6E to 6H, the second lever 120 enters the second inclined part 142*c* along the guide surface 113*a* provided at the second catching part 113 due to the elastic force Fk of the elastic member 130. The second lever 120 is supported and stopped by the second support part 145*b*. The second lever 120 is located at the first position, i.e. the standby position, and the first lever 110 is separated from the second lever 120.

The above-described processes are repeatedly performed to open and close the printing media cassette 21.

Hereinafter, the structure of an opening and closing device 200 according to another embodiment of the present invention will be described.

Figure 7:
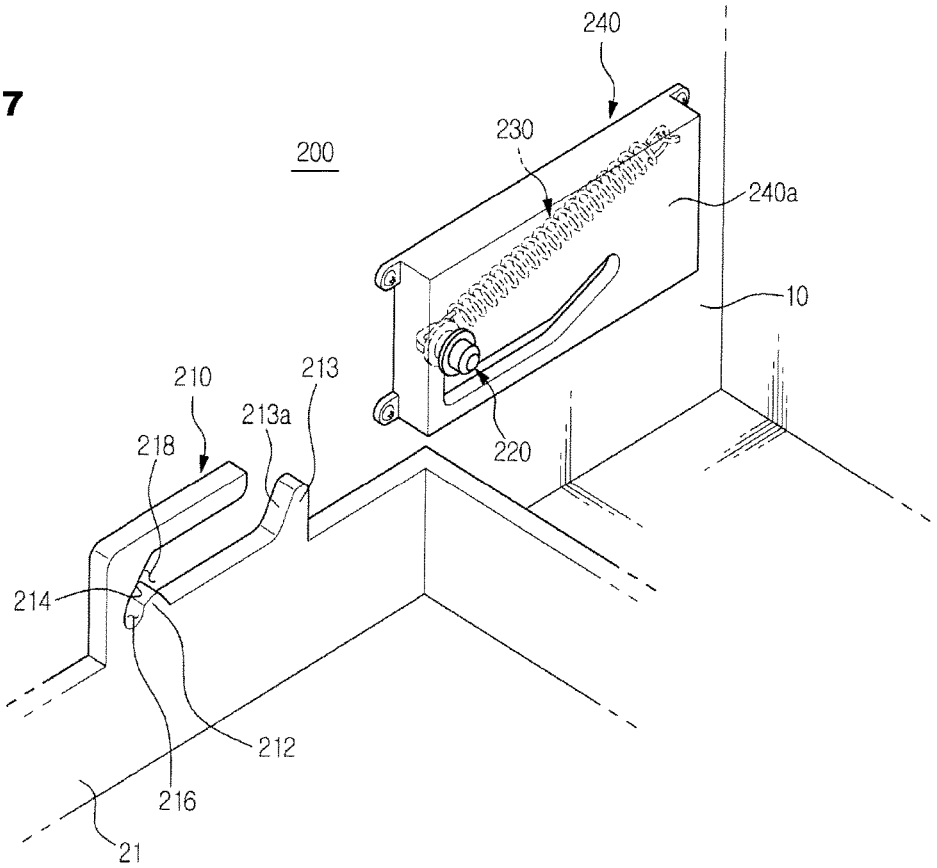
FIG. 7 is a perspective view showing an opening and closing device according to another embodiment of the present invention.
Figure 8:
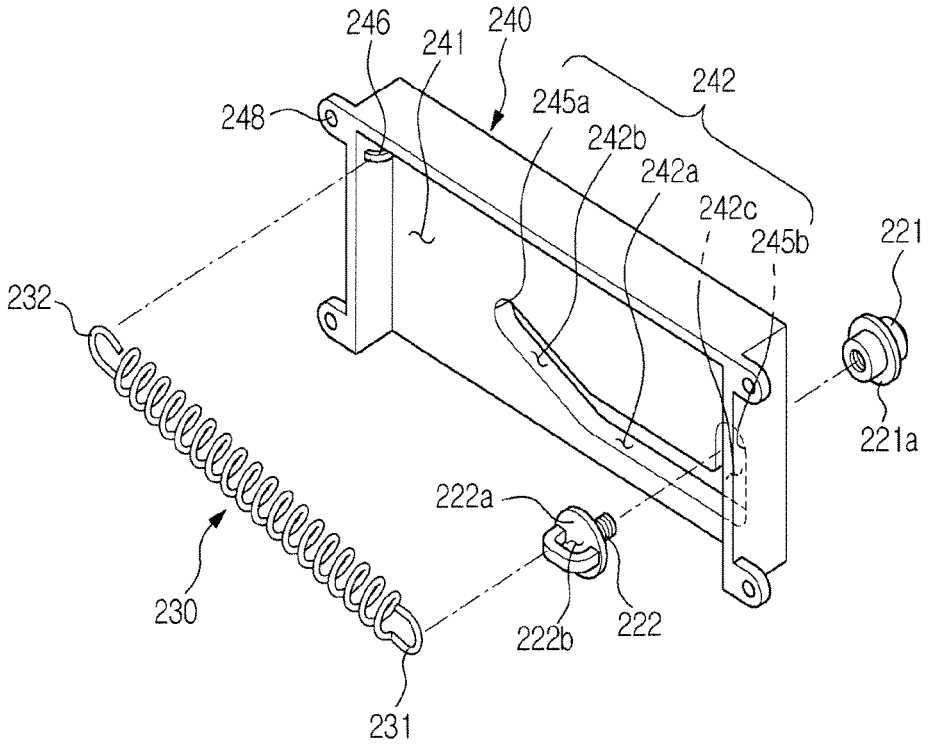
FIG. 8 is an exploded perspective view of the opening and closing device according to the embodiment of the present invention.

FIG. 7 is a perspective view showing an opening and closing device according to another embodiment of the present invention and FIG. 8 is an exploded perspective view of the opening and closing device according to the embodiment of the present invention. A first lever is omitted from FIG. 8.

As shown in FIGS. 7 and 8, the opening and closing device 200 includes a first lever 210 provided at the printing media cassette 21, a second lever 220 provided in the apparatus body 10, an elastic member 230 to elastically bias the second lever 220, and a lever housing 240 to receive and support the second lever 220 and the elastic member 230. The first lever 210 may be integrally formed with the printing media cassette 21.

The first lever 210 includes a first catching part 212 and a second catching part 213 protruding upward from a side surface of the printing media cassette 21 and a guide part 214 connected to the first catching part 212, the guide part 214 being inclined from the movement direction of the printing media cassette 21. Between the first catching part 212 and the guide part 214 is formed an opening 218, through which a portion of the second lever 220 is introduced when the printing media cassette 21 is closed.

When the printing media cassette 21 is closed, the first catching part 212 contacts the second lever 220 and is pushed by the second lever 220.

The second catching part 213 is spaced apart from the first catching part 212 in the direction in which the printing media cassette 21 is closed. When the printing media cassette 21 is opened, the second catching part 213 contacts the second lever 220 to push the second lever 220. The second catching part 213 includes a guide surface 213*a*. The guide surface 213*a* guides the second lever 220 to locate the second lever 120 at a second inclined part 242*c* of a guide slot 242 such that the second lever 220 is located at a first position, which is a standby position, when the second catching part 213 and the second lever 220 are separated from each other.

When the printing media cassette 21 is closed, the guide part 214 pushes the second lever 220. The second lever 220 is pushed by the guide part 214 and moves along the guide part 214 to contact the first catching part 212. At a connection between the guide part 214 and the first catching part 212 is formed a receiving groove 216 to receive the second lever 220, which has been moved while being pushed by the guide part 214. The second lever 220 pushes the first catching part 212 in a state in which the second lever 220 is received in the receiving groove 216.

The second lever 220 is movably disposed in the apparatus body 10. The second lever 220 includes a catching pin 221 contacting the first lever 210 when the printing media cassette 21 is closed or opened and a support pin 222 coupled and fixed to the catching pin 221.

The catching pin 221 is disposed at an outer side of the lever housing 240. The support pin 222 is disposed at an inner side of the lever housing 240. The catching pin 221 includes a first flange 221*a*. The support pin 222 includes a second flange 222*a*. The first flange 221*a* and the second flange 222*a* prevent the second lever 220 from being separated from the guide slot 242 during movement of the second lever 220. The support pin 222 is provided with a support hole 222*b*. One end 231 of the elastic member 230 is turnably supported by the support pin 222 through the support hole 222*b*.

The elastic member 230 is disposed between the second lever 220 and the lever housing 240 to elastically bias the second lever 220 such that the second lever 220 pushes the first lever 210 when the printing media cassette 21 is closed. The elastic member 230 may be constituted by a tension spring.

One end 231 of the elastic member 230 is turnably supported in the support hole 222*b* provided at the support pin 222. The other end 232 of the elastic member 230 is turnably supported by a support protrusion 246 provided at the lever housing 240. One end 231 of the elastic member 230 may turn about the other end 232 of the elastic member 230.

The lever housing 240 includes a receiving part 241 to receive the second lever 220 and the elastic member 230, a support protrusion 246 protruding from an inner surface of the lever housing 240 toward the receiving part 241, and a guide slot 242 formed through a side surface 240*a* of the lever housing 240.

The support protrusion 246 is formed in a cylindrical shape to turnably support the other end 232 of the elastic member 230.

The guide slot 242 includes a parallel part 242*a* parallel to the movement direction of the printing media cassette 21, a first inclined part 242*b* inclined from the parallel part 242*a*, the first inclined part 242*b* being connected to one end of the parallel part 242*a*, and a second inclined part 242*c* inclined from the parallel part 242*a*, the second inclined part 242*c* being connected to the other end of the parallel part 242*a*. The second inclined part 242*c* may be perpendicular to the parallel part 242*a*.

When the printing media cassette 21 is closed or opened, the guide slot 242 guides movement of the second lever 220. When the printing media cassette 21 is closed, the second lever 220 is pushed by the guide part 214, is separated from the second inclined part 242*c*, and slides along the parallel part 242*a* and the first inclined part 242*b*. When the printing media cassette 21 is opened, on the other hand, the second lever 220 is pushed by the second catching part 213, slides along the first inclined part 242*b* and the parallel part 242*a*, and enters the second inclined part 242*c*.

The first inclined part 242*b* is provided at one end thereof with a first support part 245*a*. The second inclined part 242*c* is provided at one end thereof with a second support part 245*b*. When the printing media cassette 21 is closed, the first support part 245*a* contacts the second lever 220 to support the second lever 220 and restricts slide movement of the second lever 220 such that the second lever 220 is located at a second position, which is a closed position. When the printing media cassette 21 is opened, the second support part 245*b* contacts the second lever 220 to support the second lever 220 and restricts slide movement of the second lever 220 such that the second lever 220 is located at the first position, i.e. the standby position.

The lever housing 240 is provided at the edge thereof with fixing holes 248 to fix the lever housing 240 in the apparatus body 10.

Since the opening and closing device 200 is disposed at one side of the printing media cassette 21 in the apparatus body 10 as described above, a space occupied by the opening and closing device 200 is reduced, thereby achieving miniaturization of the image forming apparatus.

A process of opening and closing the printing media cassette 21 is identical to what has been described above and, therefore, a description thereof will be omitted.

Figure 9:
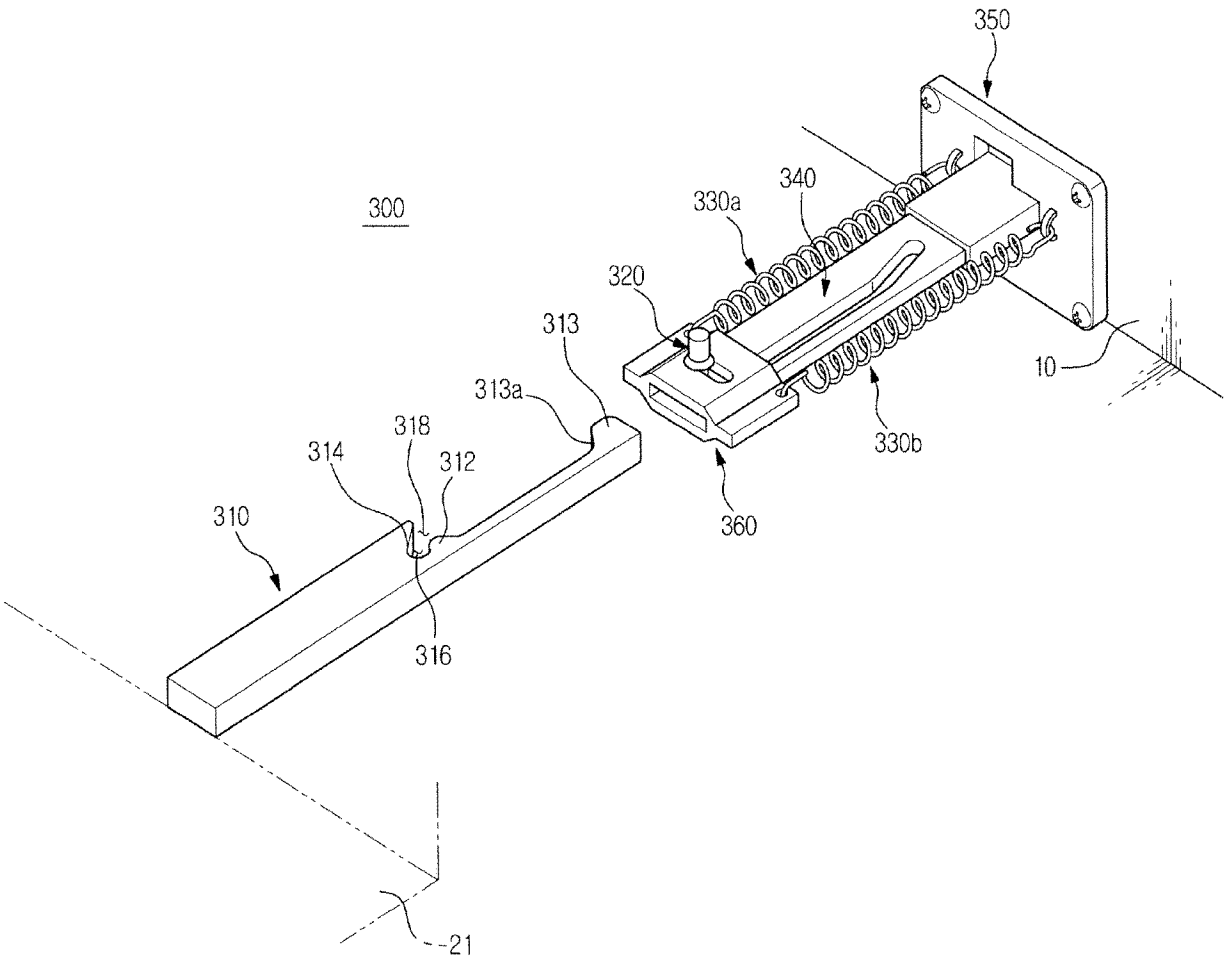
FIG. 9 is a perspective view showing an opening and closing device according to yet another embodiment of the present invention.
Figure 10:
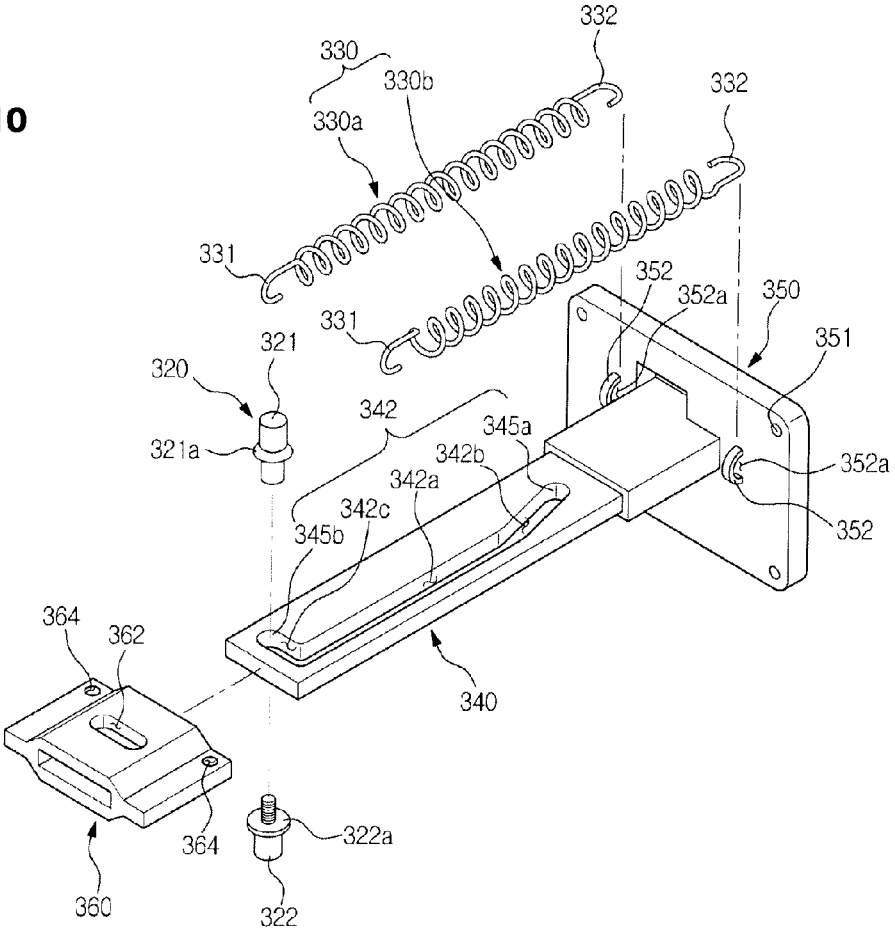
FIG. 10 is an exploded perspective view of the opening and closing device according to the embodiment of the present invention.

FIG. 9 is a perspective view showing an opening and closing device according to yet another embodiment of the present invention and FIG. 10 is an exploded perspective view of the opening and closing device according to the embodiment of the present invention. A first lever is omitted from FIG. 10.

As shown in FIGS. 9 and 10, the opening and closing device 300 includes a first lever 310 provided at the printing media cassette 21, a second lever 320 provided in the apparatus body 10, a guide plate 340 to movably support the second lever 320, a slider 360 slidably coupled to the guide plate 340, an elastic member 330 to elastically bias the slider 360, and a fixing plate 350 to support the elastic member 330 and the guide plate 340. The first lever 310 may be integrally formed with the printing media cassette 21.

The first lever 310 protrudes backward from a rear surface of the printing media cassette 21. The first lever 310 includes a first catching part 312, a second catching part 313, and a guide part 314 connected to the first catching part 312, the guide part 314 being inclined from the movement direction of the printing media cassette 21. Between the first catching part 312 and the guide part 314 is formed an opening 318, through which a portion of the second lever 320 is introduced when the printing media cassette 21 is closed.

When the printing media cassette 21 is closed, the first catching part 312 contacts the second lever 320 and is pushed by the second lever 320.

The second catching part 313 is spaced apart from the first catching part 312 in the direction in which the printing media cassette 21 is closed. When the printing media cassette 21 is opened, the second catching part 313 contacts the second lever 320 to push the second lever 320. The second catching part 313 includes a guide surface 313*a*. The guide surface 313*a* guides the second lever 320 to locate the second lever 320 at a second inclined part 342*c* of a first guide slot 342 such that the second lever 320 is located at a first position, which is a standby position, when the second catching part 313 and the second lever 320 are separated from each other.

When the printing media cassette 21 is closed, the guide part 314 pushes the second lever 320. The second lever 320 is pushed by the guide part 314 and moves along the guide part 314 to contact the first catching part 312. At a connection between the guide part 314 and the first catching part 312 is formed a receiving groove 316 to receive the second lever 320, which has been moved while being pushed by the guide part 314. The second lever 320 pushes the first catching part 312 in a state in which the second lever 320 is received in the receiving groove 316.

The second lever 320 is movably disposed in the apparatus body 10. The second lever 320 includes a catching pin 321 contacting the first lever 310 when the printing media cassette 21 is closed or opened and a support pin 322 coupled and fixed to the catching pin 321 via the guide plate 340 and the slider 360.

The catching pin 321 includes a first flange 321*a*. The support pin 322 includes a second flange 322*a*. The first flange 321*a* and the second flange 322*a* prevent the second lever 320 from being separated from the guide plate 340 and the slider 360 during movement of the second lever 320.

The slider 360 includes a second guide slot 362 to guide movement of the second lever 320 and first support holes 364 to support one end 331 of the elastic member 330. The second guide slot 362 is provided perpendicular to the movement direction of the printing media cassette 21. The second guide slot 362 interconnects the slider 360 and the second lever 320 such that the slider 360 and the second lever 320 move together.

The elastic member 330 is disposed between the slider 360 and the fixing plate 350 to elastically bias the slider 360. The elastic member 330 may include a first elastic member 330*a* and a second elastic member 330*b* disposed at opposite sides of the guide plate 340.

When the printing media cassette 21 is closed, elastic force of the elastic member 330 is applied to the slider 360 to move the slider 360 in the direction in which the printing media cassette 21 is closed. At the same time, the second lever 320 is pushed by the slider 360 through the second guide slot 362 and slides along the first guide slot 342 and the second guide slot 362.

One end 331 of the elastic member 330 is supported in the first support holes 364 provided at the slider 360. The other end 332 of the elastic member 330 is supported in second support holes 352*a* provided at the fixing plate 350. The elastic member 330 may be constituted by a tension spring.

The guide plate 340 includes a first guide slot 342 to guide slide movement of the second lever 320. The first guide slot 342 includes a parallel part 342*a* parallel to the movement direction of the printing media cassette 21, a first inclined part 342*b* inclined from the parallel part 342*a*, the first inclined part 342*b* being connected to one end of the parallel part 342*a*, and a second inclined part 342*c* inclined from the parallel part 342*a*, the second inclined part 342*c* being connected to the other end of the parallel part 342*a*. The second inclined part 342*c* may be perpendicular to the parallel part 342*a*.

When the printing media cassette 21 is closed or opened, the first guide slot 342 guides movement of the second lever 320. When the printing media cassette 21 is closed, the second lever 320 is pushed by the guide part 314, is separated from the second inclined part 342*c*, and slides along the parallel part 342*a* and the first inclined part 342*b*. When the printing media cassette 21 is opened, on the other hand, the second lever 320 is pushed by the second catching part 313, slides along the first inclined part 342*b* and the parallel part 342*a*, and enters the second inclined part 342*c*.

The first inclined part 342*b* is provided at one end thereof with a first support part 345*a*. The second inclined part 342*c* is provided at one end thereof with a second support part 345*b*. When the printing media cassette 21 is closed, the first support part 345*a* contacts the second lever 320 to support the second lever 320 and restricts slide movement of the second lever 320 such that the second lever 320 is located at a second position, which is a closed position. When the printing media cassette 21 is opened, the second support part 345*b* contacts the second lever 320 to support the second lever 320 and restricts slide movement of the second lever 320 such that the second lever 320 is located at the first position, i.e. the standby position.

The guide plate 340 extends from the fixing plate 350 toward the printing media cassette 21.

The fixing plate 350 includes a plurality of fixing holes 351 to fix the fixing plate 350 in the apparatus body 10 and support protrusions 352 to support the elastic member 330. Each support protrusion 352 is provided with a second support hole 352*a*. The other end 332 of the elastic member 330 is supported by the support protrusions 352 through the second support holes 352*a*.

Hereinafter, a process of opening and closing the printing media cassette 21 will be described.

FIGS. 11A to 11G are views showing a process of closing the printing media cassette.

Figure 11A:
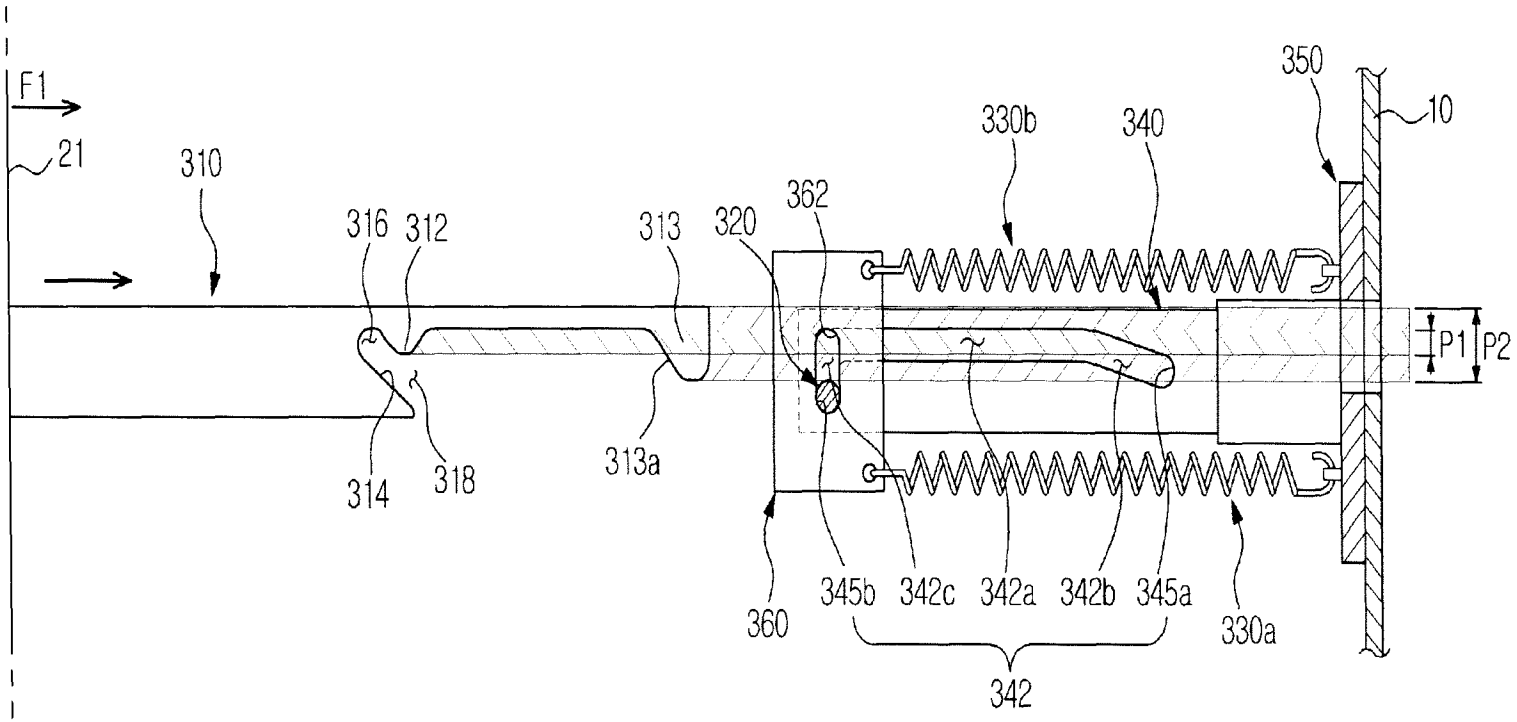
FIGS. 11A to 11G are views showing a process of closing the printing media cassette.
Figure 11B:
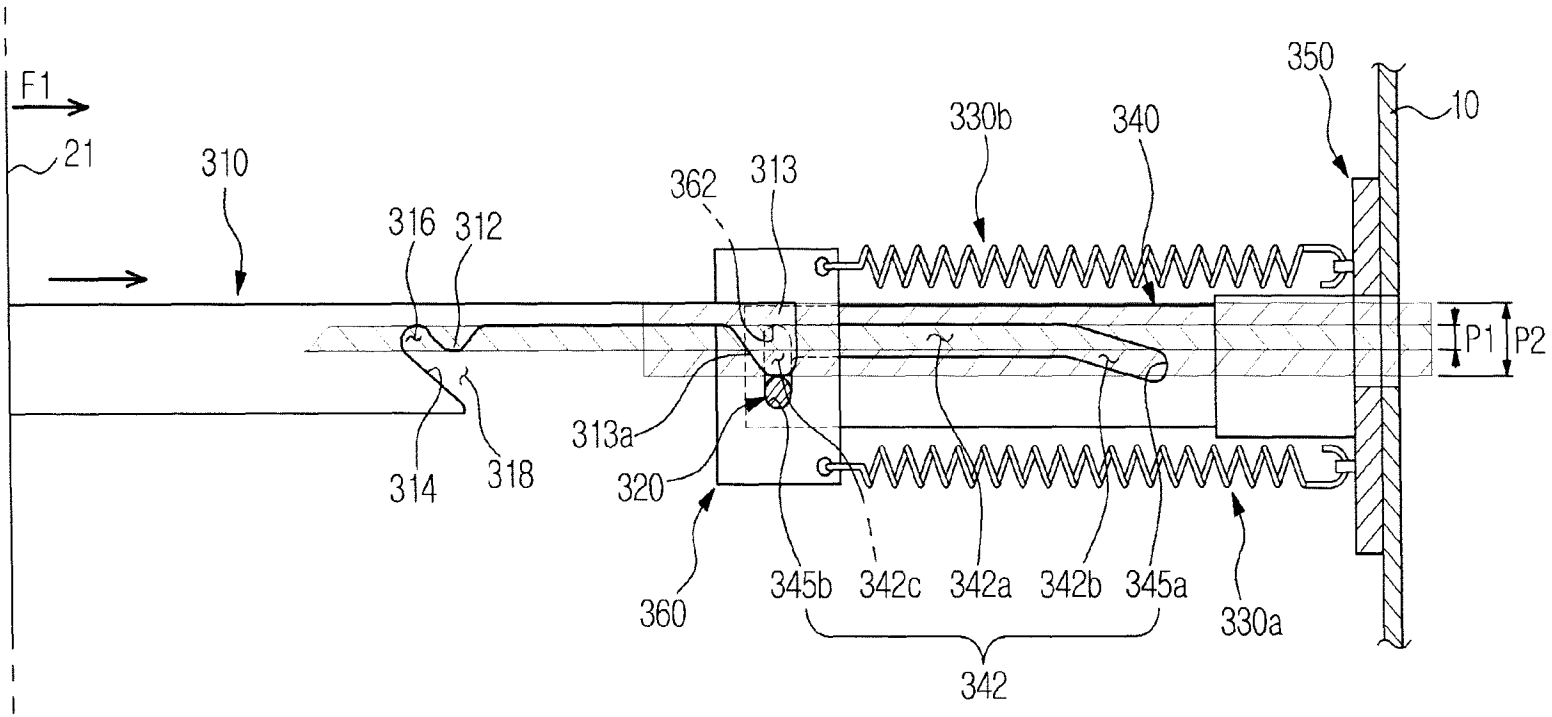
Figure 11C:
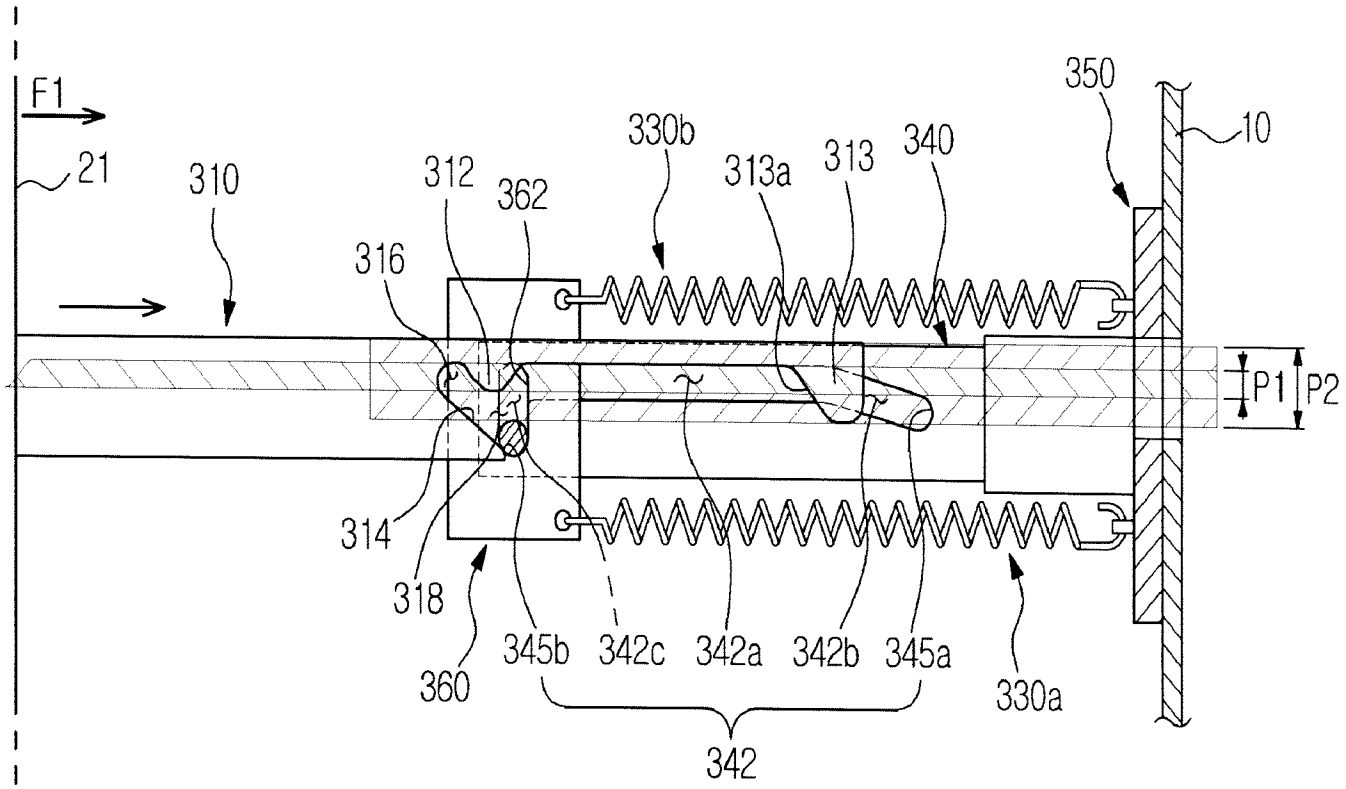
Figure 11D:
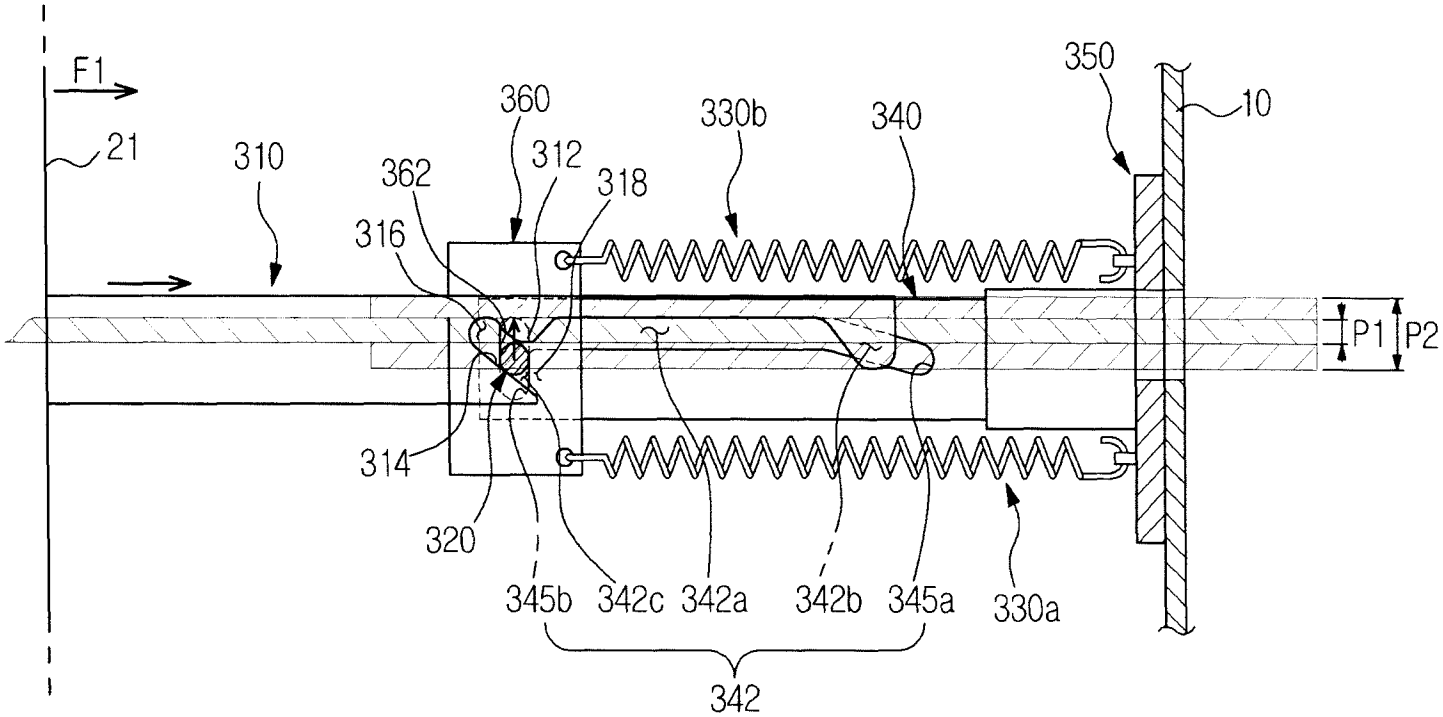
Figure 11E:
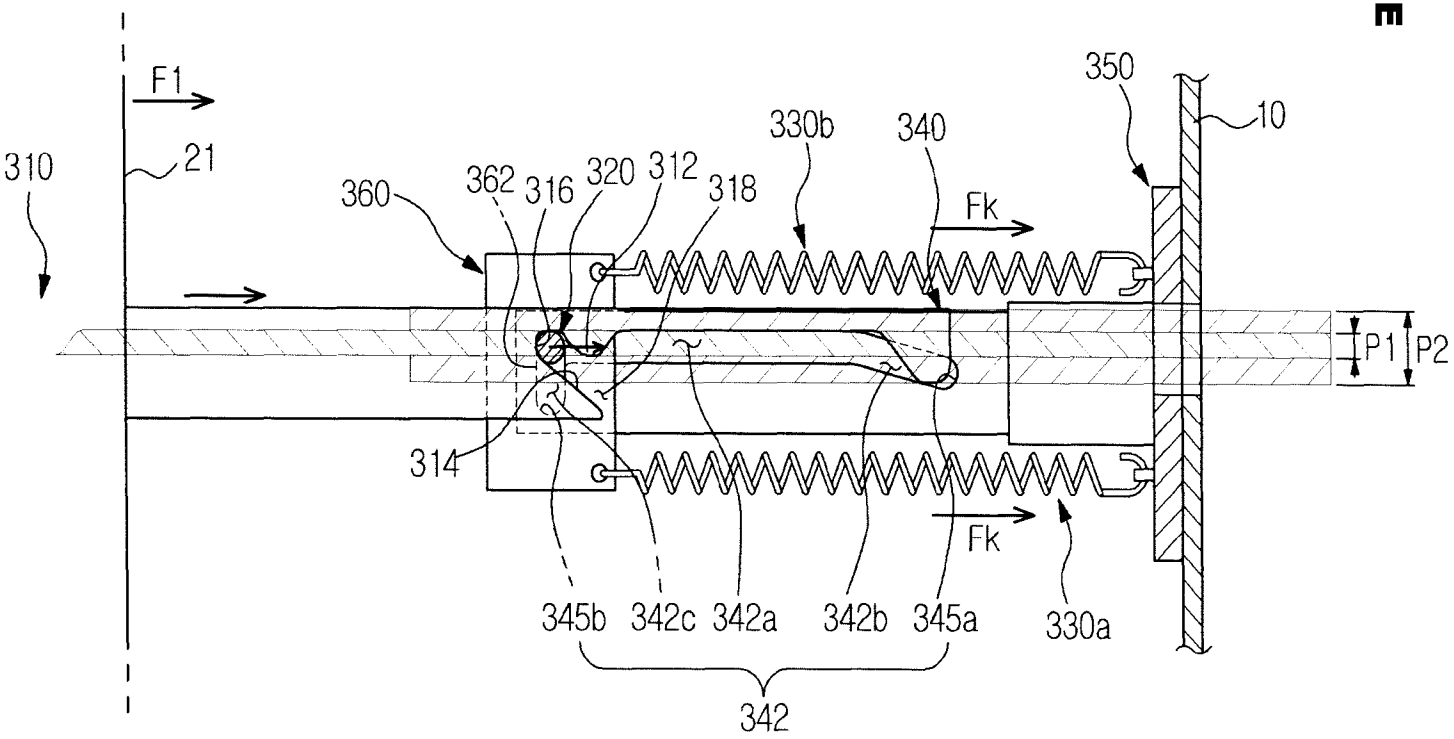

In a state in which the printing media cassette 21 is open, as shown in FIG. 11A, the second lever 320 of the opening and closing device 300 is located at the first position, i.e. the standby position. At this time, the second lever 320 is received in the second inclined part 342*c* of the first guide slot 342 and is supported and stopped by the second support part 345*b*. In a state in which the second lever 320 is located at the first position, the second lever 320 is located outside a movement path P2 of the second catching part 313 such that the second lever 320 does not interfere with the second catching part 313.

When the user applies force F1 to the printing media cassette 21, as shown in FIGS. 11B to 11E, the printing media cassette 21 enters the apparatus body 10. The second lever 320 is pushed by the guide part 314, is separated from the second inclined part 342*c*, and enters the parallel part 342*a*. At this time, the second lever 320 is received in the receiving groove 316 of the first lever 310 and contacts the first catching part 312.

Figure 11F:
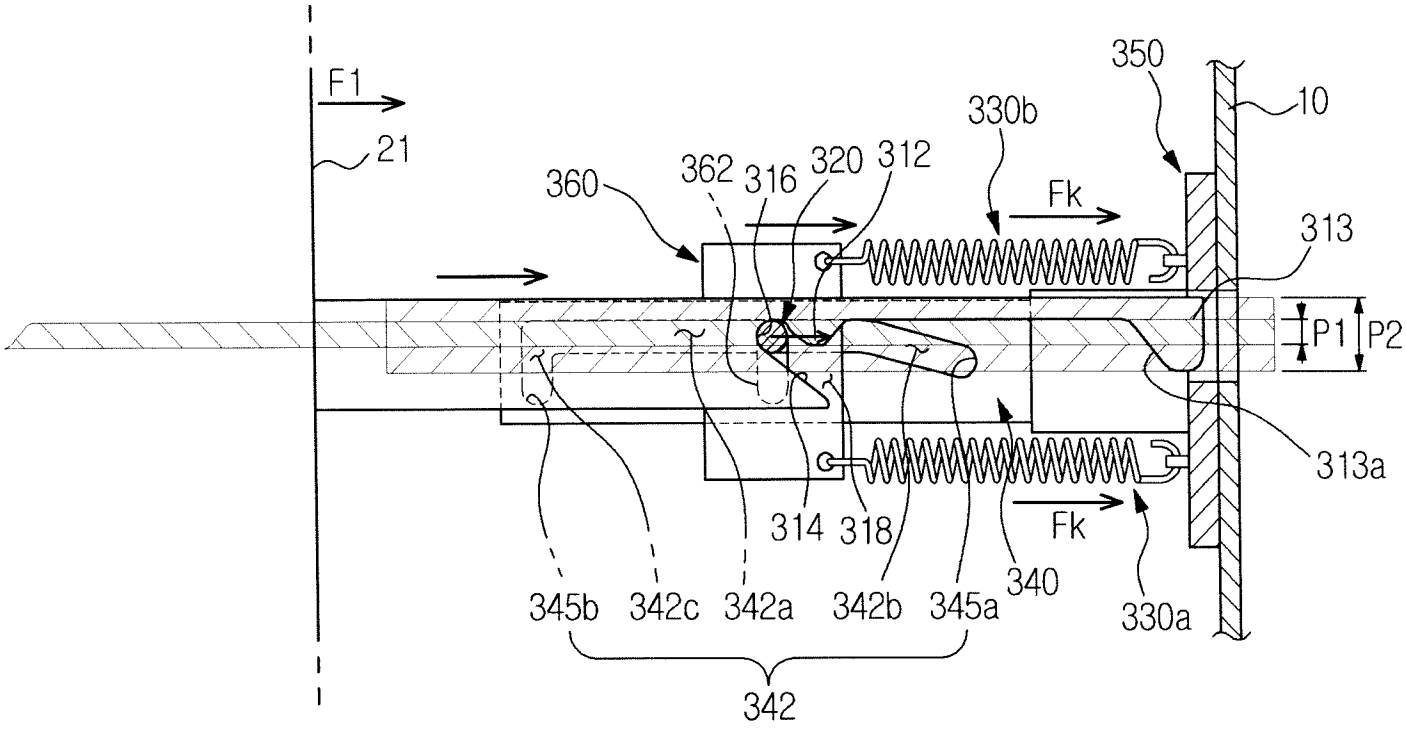

When the second lever 320 enters the parallel part 342*a*, as shown in FIG. 11F, the slider 360 slides along the guide plate 340 in the direction in which the printing media cassette 21 is closed due to elastic force Fk of the elastic member 330 applied to the slider 360. The second lever 320 slides along the parallel part 342*a* and the first inclined part 342*b*. During slide movement of the second lever 320 along the parallel part 342*a* and the first inclined part 342*b*, the second lever 320 pushes the first lever 310 via the first catching part 312 to pull the printing media cassette 21 into the apparatus body 10. Consequently, the user may easily close the printing media cassette 21 using low force.

Figure 11G:
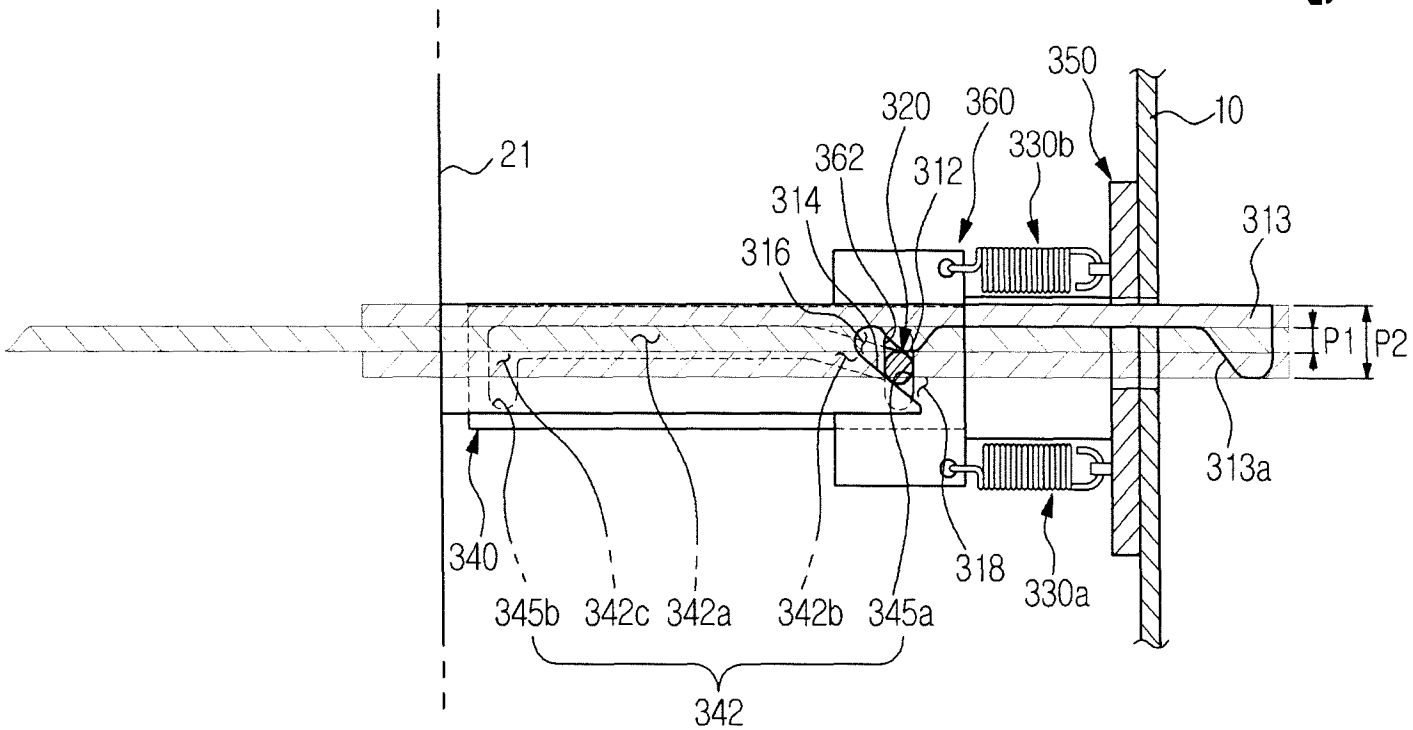

When the printing media cassette 21 is completely closed, as shown in FIG. 11G, the second lever 320 contacts the first support part 345*a* and is thus stopped and is located at the second position, i.e. the closed position. When the second lever 320 is stopped, the second lever 320 is separated from the first lever 310. That is, the second lever 320 is separated from the printing media cassette 21.

In a state in which the second lever 320 is located at the second position, the second lever 320 is located outside a movement path P1 of the first catching part 312 such that the second lever 320 does not interfere with the first catching part 312.

FIGS. 12A to 12H are views showing a process of opening the printing media cassette.

Figure 12A:
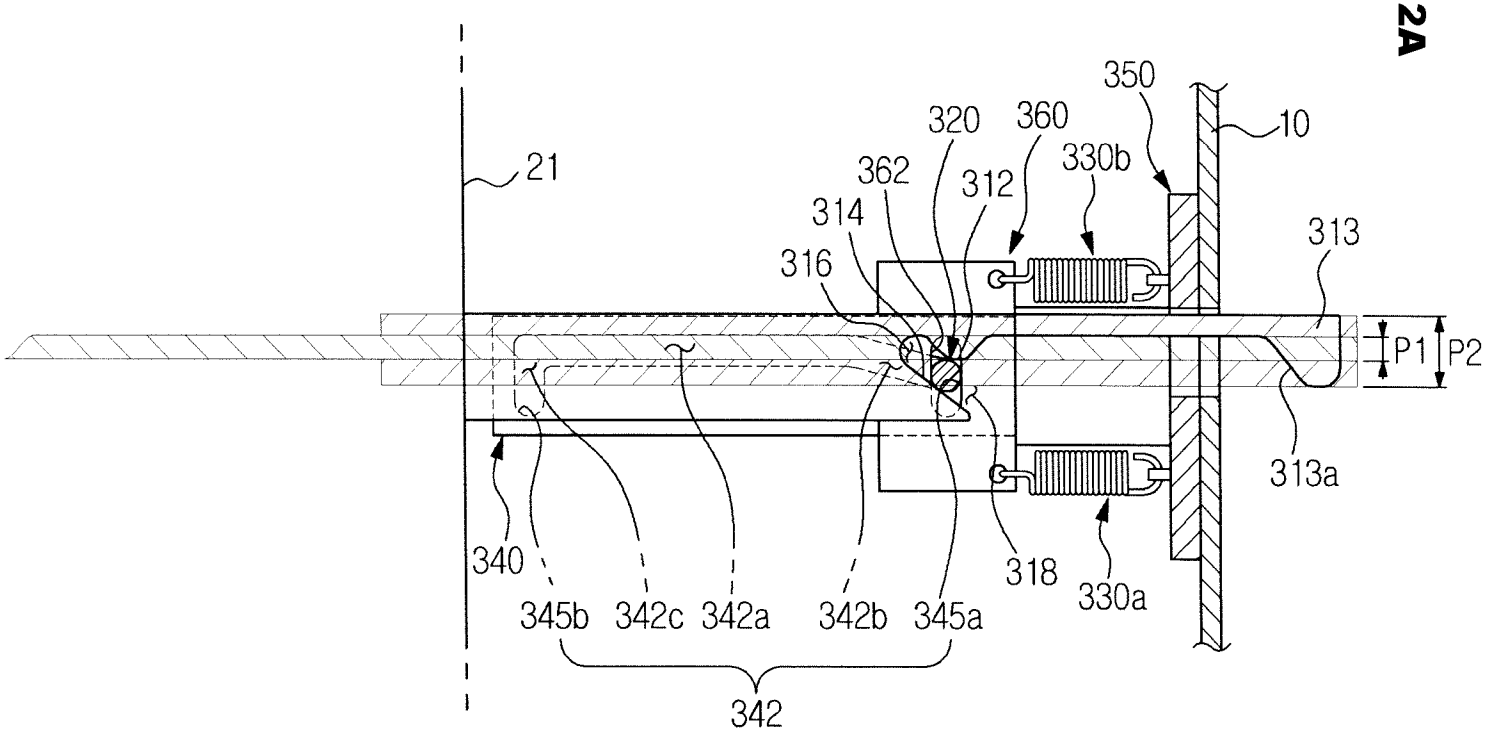
FIGS. 12A to 12H are views showing a process of opening the printing media cassette.
Figure 12B:
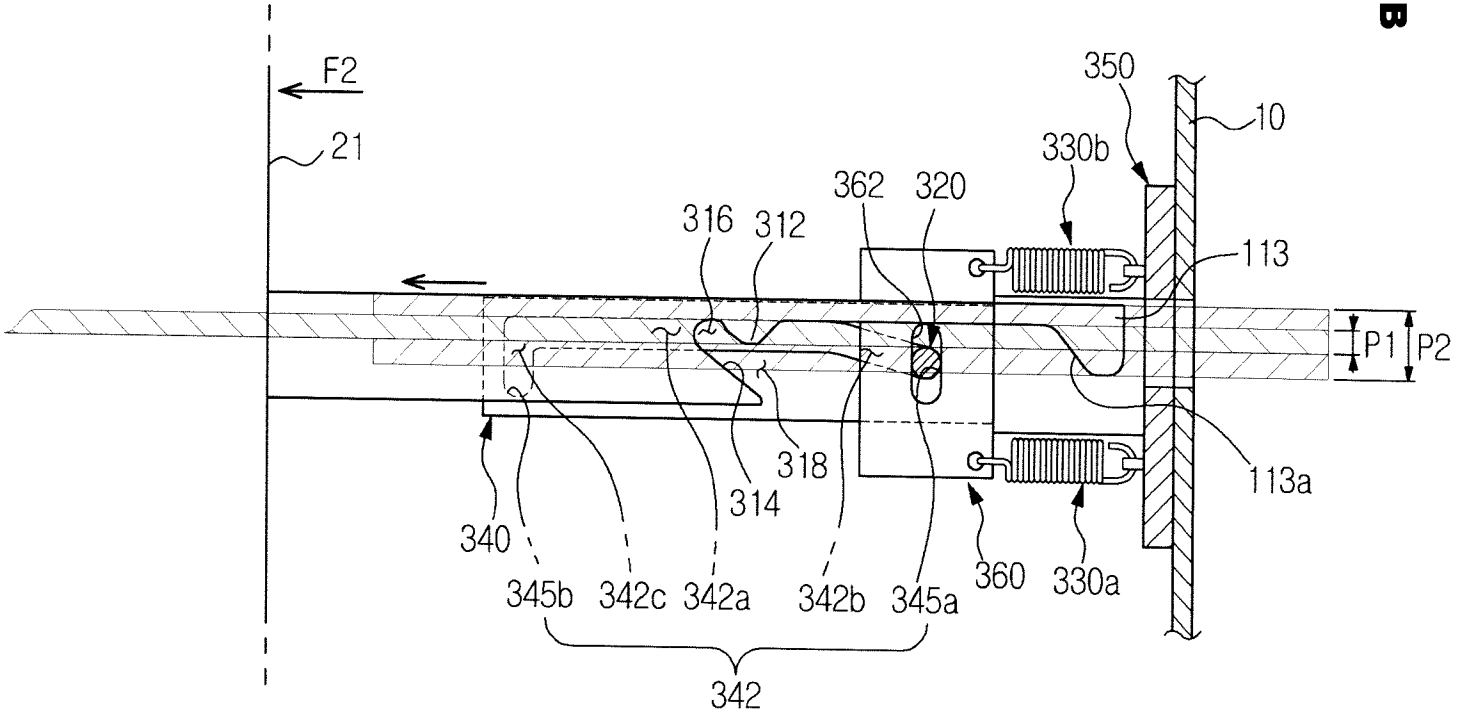

When the user applies force F2 to the printing media cassette 21 in a state in which the printing media cassette 21 is closed, as shown in FIGS. 12A and 12B, the printing media cassette 21 moves in the direction opposite to the direction in which the printing media cassette 21 enters the apparatus body 10. Since the second lever 320 is located outside the movement path P1 of the first catching part 312 such that the second lever 320 does not interfere with the first catching part 312, the second lever 320 is located and stopped at the second position. The printing media cassette 21 and the first lever 310 freely move without interference with the second lever 320. That is, any force from the opening and closing device 300 is not applied to the printing media cassette 21 excluding the force F2 applied by the user. Consequently, the user may pull the printing media cassette 21 from the apparatus body 10 using low force in a state in which the printing media cassette 21 is closed.

At this time, the slider 360, which receives the second lever 320, also remains stopped.

Figure 12C:
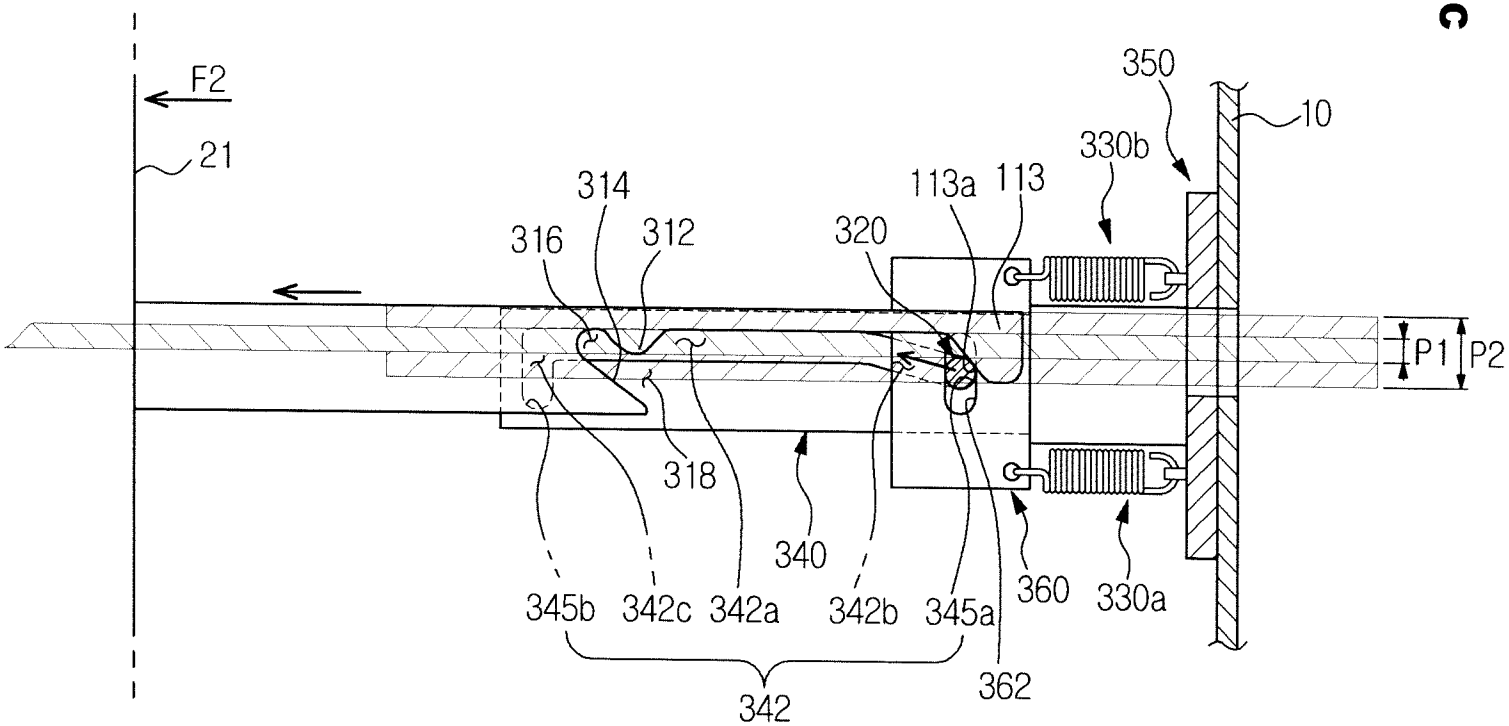
Figure 12D:
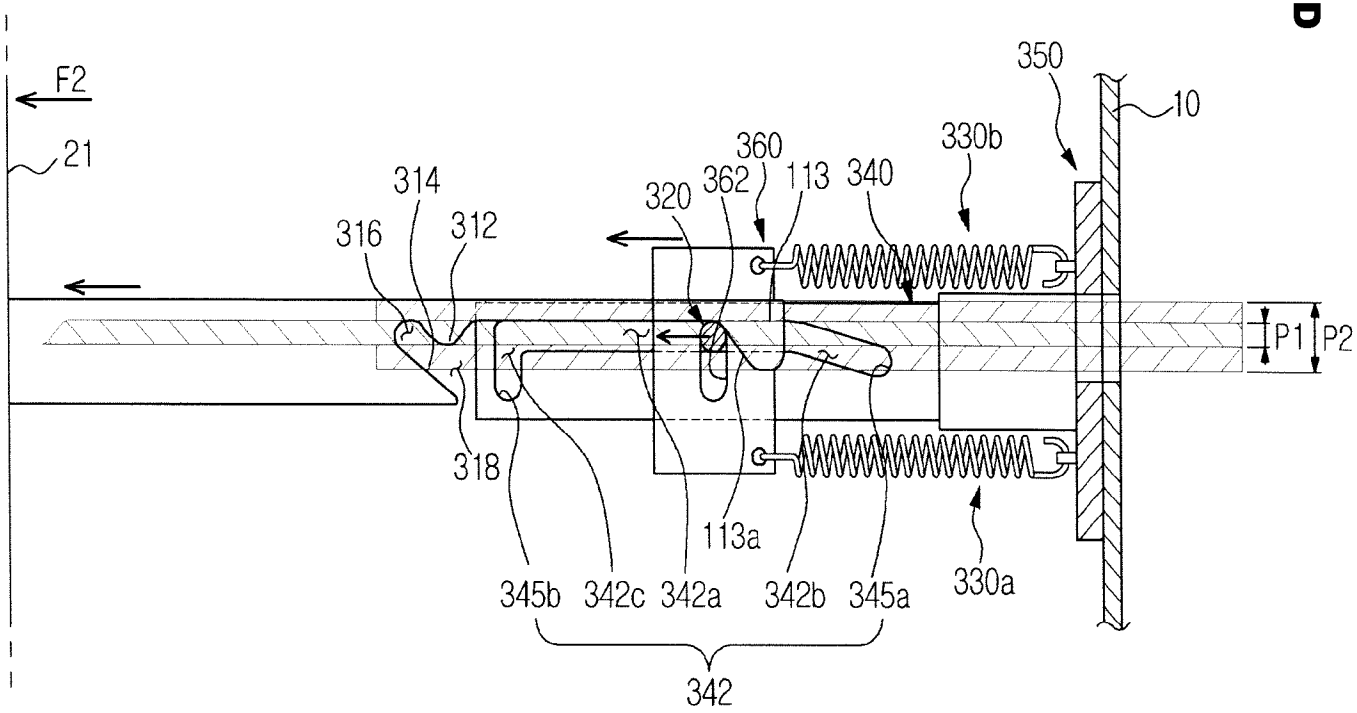
Figure 12E:
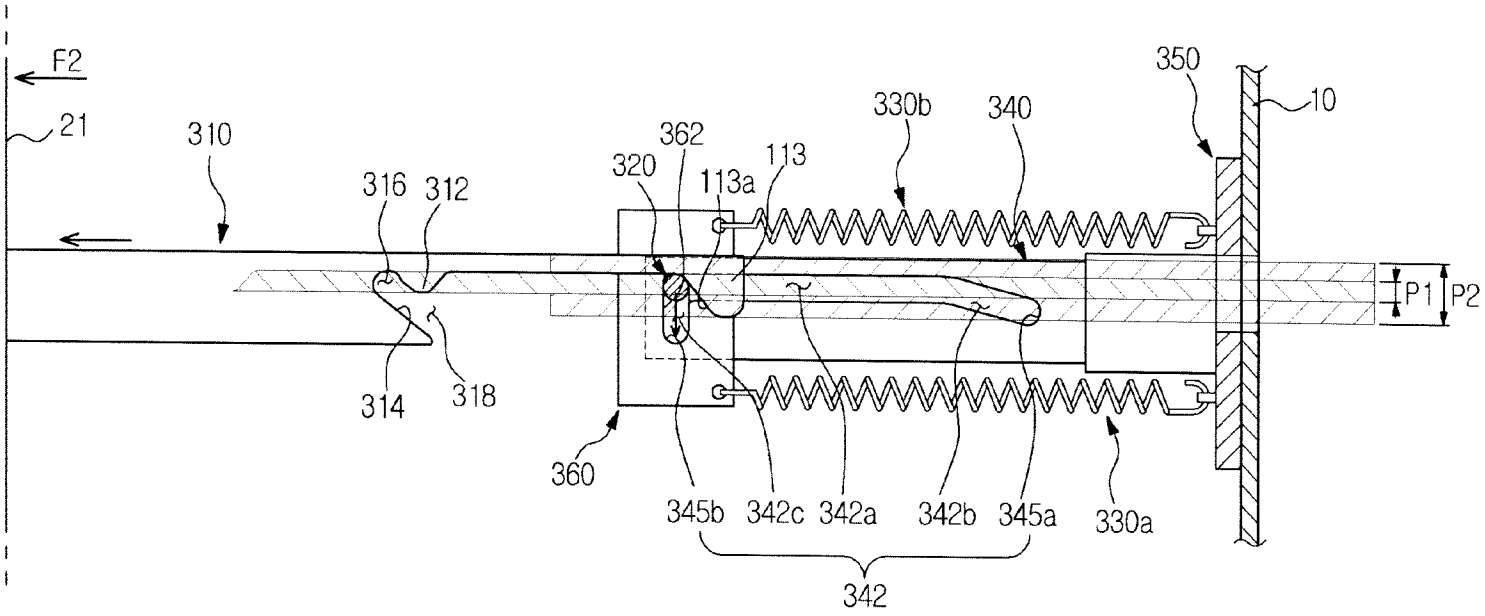
Figure 12F:
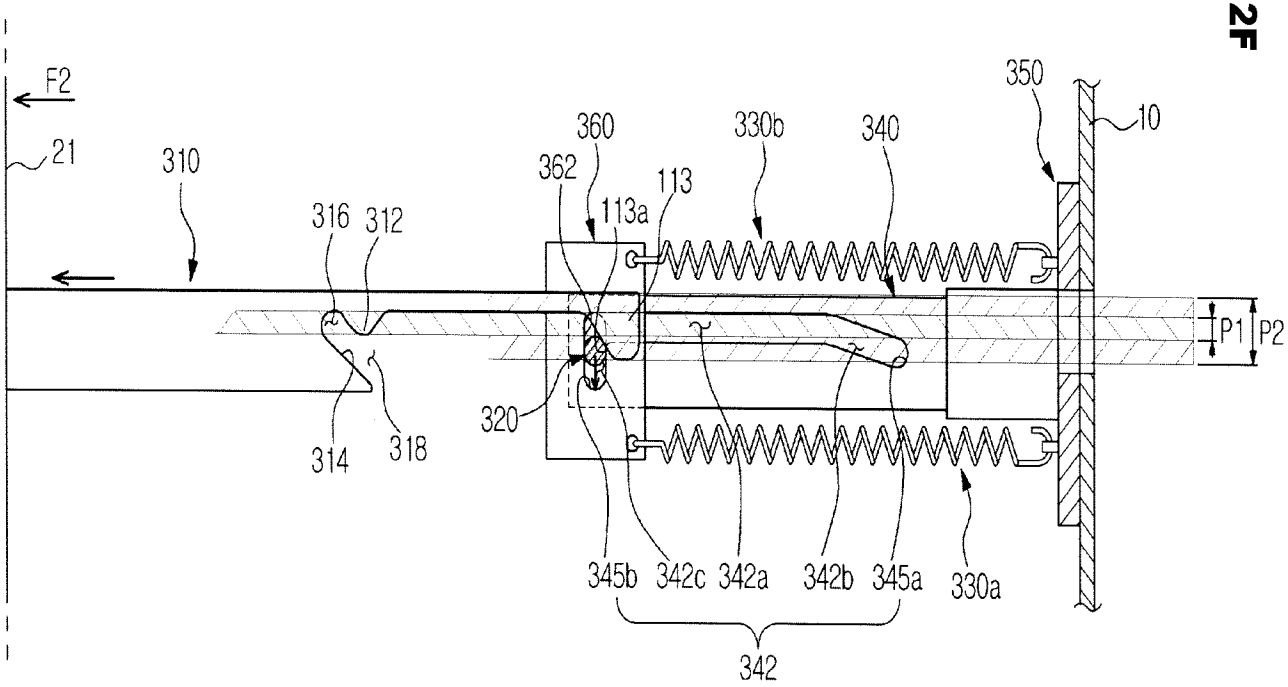
Figure 12G:
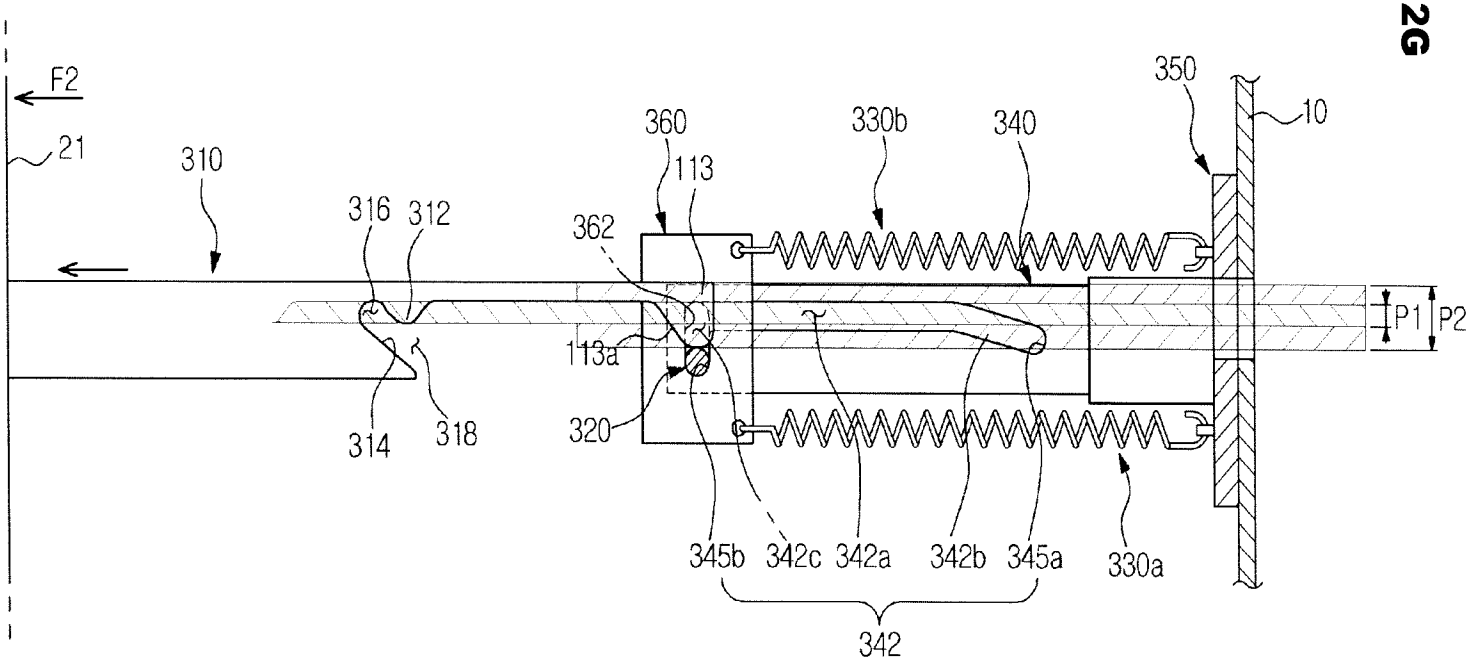
Figure 12H:
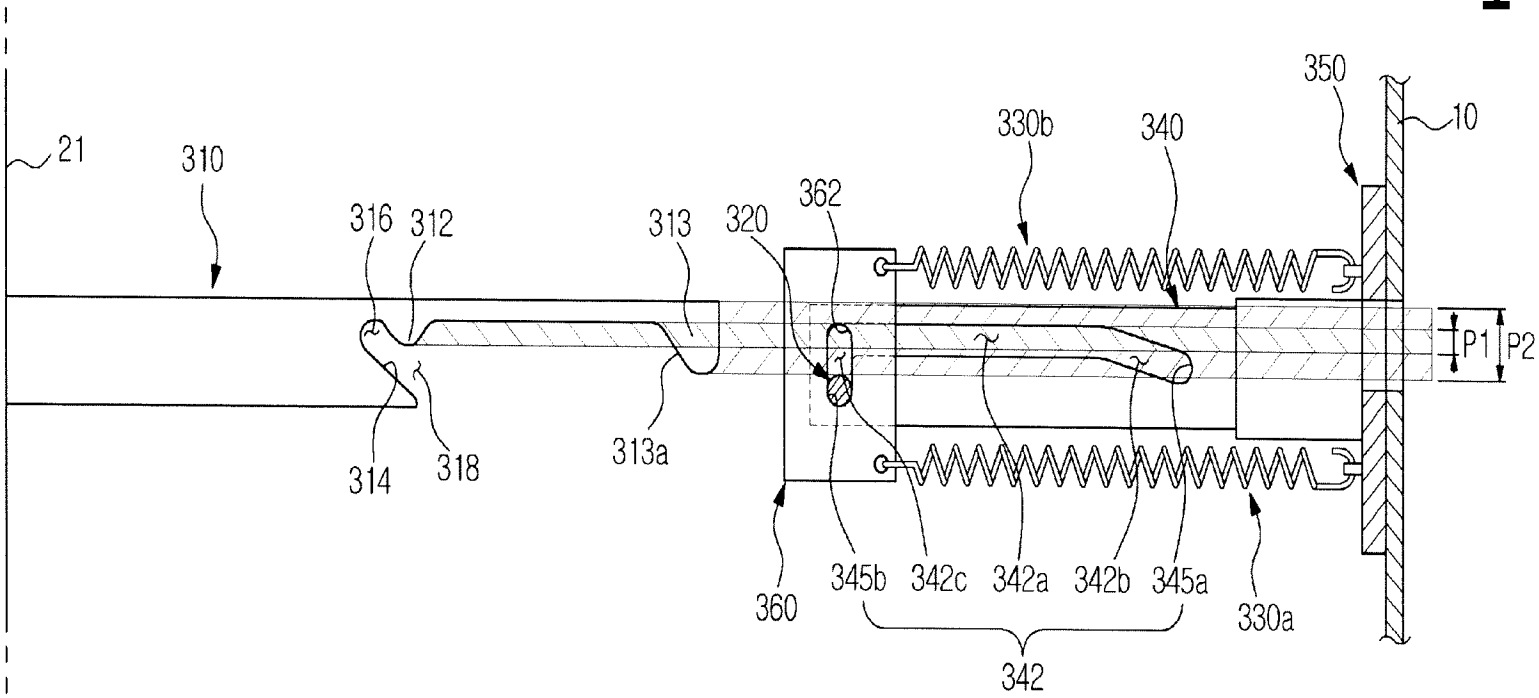

When the second catching part 313 of the first lever 310 contacts the second lever 320, as shown in FIGS. 12C and 12D, the second lever 320 is pushed by the second catching part 313 and slides along the first inclined part 342*b* and the parallel part 342*a*. The slider 360 is pushed by the second lever 320 through the second guide slot 362 and slides along the guide plate 340 in the direction in which the printing media cassette 21 is opened. The elastic member 330 connected to the slider 360 is extended to accumulate elastic force. The second catching part 313 of the first lever 310 is accelerated until the second catching part 313 contacts the second lever 320. The accelerated second catching part 313 contacts the second lever 320 to push the second lever 320. Consequently, the user may pull the printing media cassette 21 using low force.

When the second lever 320 slides along the first inclined part 342*b* and the parallel part 342*a* and reaches the end of the parallel part 342*a*, as shown in FIGS. 12E to 12H, the second lever 320 enters the second inclined part 342*c* along the guide surface 313*a* provided at the second catching part 313 due to the elastic force Fk of the elastic member 330. The second lever 320 is supported and stopped by the second support part 345*b*. The second lever 320 is located at the first position, i.e. the standby position, and the first lever 310 is separated from the second lever 320.

The above-described processes are repeatedly performed to open and close the printing media cassette 21.

Figure 13:
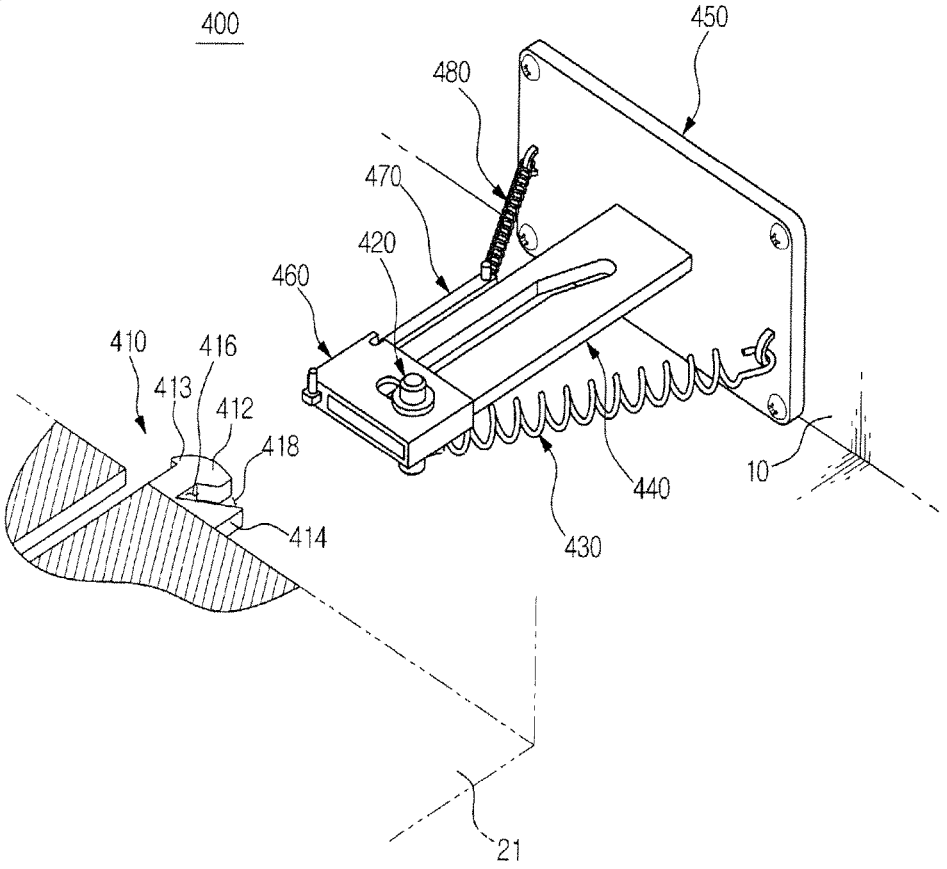
FIG. 13 is a perspective view showing an opening and closing device according to a further embodiment of the present invention.
Figure 14:
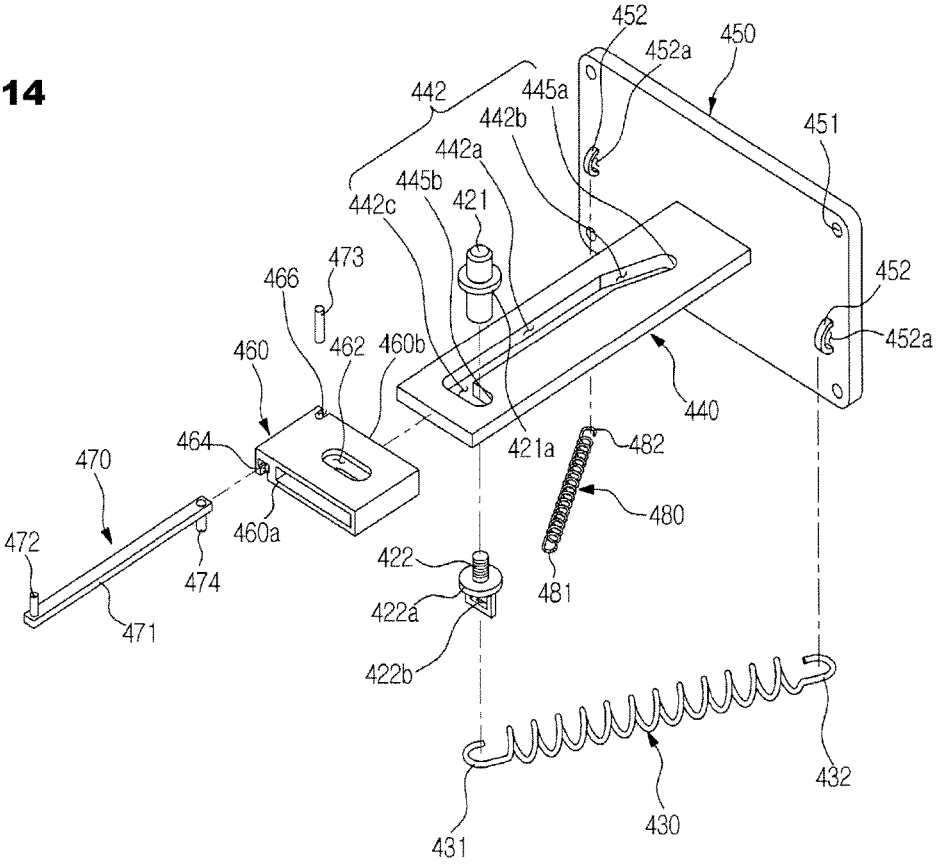
FIG. 14 is an exploded perspective view of the opening and closing device according to the embodiment of the present invention.

FIG. 13 is a perspective view showing an opening and closing device according to a further embodiment of the present invention and FIG. 14 is an exploded perspective view of the opening and closing device according to the embodiment of the present invention. A first lever is omitted from FIG. 14.

As shown in FIGS. 13 and 14, the opening and closing device 400 includes a first lever 410 provided at the printing media cassette 21, a second lever 420 provided in the apparatus body 10, a guide plate 440 to movably support the second lever 420, a slider 460 slidably coupled to the guide plate 440, a connection lever 470 to interconnect the first lever 410 and the slider 460 when the printing media cassette 21 is opened, a first elastic member 430 to elastically bias the second lever 420, a second elastic member 480 to elastically bias the connection lever 470, and a fixing plate 450 to support the first elastic member 430, the second elastic member 480, and the guide plate 440. The first lever 410 may be integrally formed with the printing media cassette 21.

The first lever 410 protrudes backward from a rear surface of the printing media cassette 21. The first lever 410 includes a first catching part 412, a second catching part 413, and a guide part 414 inclined from the movement direction of the printing media cassette 21. Between the first catching part 412 and the guide part 414 is formed an opening 418, through which a portion of the second lever 420 is introduced when the printing media cassette 21 is closed.

When the printing media cassette 21 is closed, the first catching part 412 contacts the second lever 420 and is pushed by the second lever 420 in the direction in which the printing media cassette 21 is closed.

When the printing media cassette 21 is opened, the second catching part 413 contacts the connection lever 470 to push the connection lever 470 in the direction in which the printing media cassette 21 is opened.

When the printing media cassette 21 is closed, the guide part 414 pushes the second lever 420. The second lever 420 is pushed by the guide part 414 and moves along the guide part 414 to contact the first catching part 412. At a connection between the guide part 414 and the first catching part 412 is formed a receiving groove 416 to receive the second lever 420, which has been moved while being pushed by the guide part 414. The second lever 420 pushes the first catching part 412 in the direction in which the printing media cassette 21 is opened in a state in which the second lever 420 is received in the receiving groove 416.

The second lever 420 is movably disposed in the apparatus body 10. The second lever 420 includes a catching pin 421 contacting the first lever 410 when the printing media cassette 21 is closed or opened and a support pin 422 coupled and fixed to the catching pin 421 via the guide plate 440 and the slider 460.

The catching pin 421 includes a first flange 421*a*. The support pin 422 includes a second flange 422*a*. The first flange 421*a* and the second flange 422*a* prevent the second lever 420 from being separated from the guide plate 440 and the slider 460 during movement of the second lever 420. The support pin 422 is provided with a first support hole 422*b*. One end 431 of the first elastic member 430 is turnably supported by the support pin 422 through the first support hole 422*b*.

The slider 460 includes a second guide slot 462 to guide movement of the second lever 420, a guide groove 464 to guide movement of the connection lever 470, a protrusion receiving groove 466 to restrict movement of the connection lever 470.

The second guide slot 462 is provided perpendicular to the movement direction of the printing media cassette 21. The second guide slot 462 interconnects the slider 460 and the second lever 420 such that the slider 460 and the second lever 420 move together. The guide groove 464 is provided at one side of the slider 460 to support the connection lever 470 such that the connection lever 470 is not separated from the slider 460. The protrusion receiving groove 466 is formed at a rear surface 460*b* of the slider 460. When the printing media cassette 21 is opened, the protrusion receiving groove 466 receives a second catching protrusion 473 of the connection lever 470 to restrict movement of the connection lever 470. The slider 460 is pushed and moved by the connection lever 470 in the direction in which the printing media cassette 21 is opened.

The connection lever 470 includes a lever body 471, a first catching protrusion 472 protruding from one end of the lever body 471, and a second catching protrusion 473 coupled to the other end of the lever body 471. When the printing media cassette 21 is opened, the first catching protrusion 472 is pushed by the first lever 410 and the second catching protrusion 473 is received in the protrusion receiving groove 466 to push the slider 460. In addition, the connection lever 470 further includes a support protrusion 474 protruding from the other end of the lever body 471 in an opposite direction of the second catching protrusion 473. One end 481 of the second elastic member 480 is turnably supported by the support protrusion 474.

The first elastic member 430 is disposed between the second lever 420 and the fixing plate 450 to elastically bias the second lever 420. When the printing media cassette 21 is closed, elastic force of the first elastic member 430 is applied to the second lever 420 to move the second lever 420 and the slider 460 in the direction in which the printing media cassette 21 is closed.

One end 431 of the first elastic member 430 is supported in the first support hole 422*b* provided at the support pin 422. The other end 432 of the first elastic member 430 is supported in a second support hole 452*a* provided at the fixing plate 450. The first elastic member 430 may be constituted by a tension spring.

The second elastic member 480 is disposed between the connection lever 470 and the fixing plate 450 to elastically bias the connection lever 470. When the printing media cassette 21 is opened, the first lever 410 and the connection lever 470 are separated from each other and the connection lever 470 moves in the direction in which the printing media cassette 21 is closed due to elastic force of the second elastic member 480. When the printing media cassette 21 is closed, the second lever 420 and the slider 460 moves in the direction in which the printing media cassette 21 is closed due to the elastic force of the first elastic member 430 and, at the same time, the connection lever 470 moves in the direction in which the printing media cassette 21 is closed due to the elastic force of the second elastic member 480.

One end 481 of the second elastic member 480 is supported by the support protrusion 474 provided at the connection lever 470. The other end 482 of the second elastic member 480 is supported in another second support hole 452*a* provided at the fixing plate 450. The second elastic member 480 may be constituted by a tension spring.

The guide plate 440 includes a first guide slot 442 to guide slide movement of the second lever 420. The first guide slot 442 includes a parallel part 442*a* parallel to the movement direction of the printing media cassette 21, a first inclined part 442*b* inclined from the parallel part 442*a*, the first inclined part 442*b* being connected to one end of the parallel part 442*a*, and a second inclined part 442*c* inclined from the parallel part 442*a*, the second inclined part 442*c* being connected to the other end of the parallel part 442*a*. The second inclined part 442*c* may be perpendicular to the parallel part 442*a*.

When the printing media cassette 21 is closed or opened, the first guide slot 442 guides movement of the second lever 420. When the printing media cassette 21 is closed, the second lever 420 is pushed by the guide part 414, is separated from the second inclined part 442*c*, and slides along the parallel part 442*a* and the first inclined part 442*b*. When the printing media cassette 21 is opened, on the other hand, the second lever 420 is pushed by the slider 460, slides along the first inclined part 442*b* and the parallel part 442*a*, and enters the second inclined part 442*c*.

The first inclined part 442*b* is provided at one end thereof with a first support part 445*a*. The second inclined part 442*c* is provided at one end thereof with a second support part 445*b*. When the printing media cassette 21 is closed, the first support part 445*a* contacts the second lever 420 to support the second lever 420 and restricts slide movement of the second lever 420 such that the second lever 420 is located at a second position, which is a closed position. When the printing media cassette 21 is opened, the second support part 445*b* contacts the second lever 420 to support the second lever 420 and restricts slide movement of the second lever 420 such that the second lever 420 is located at a first position, which is a standby position.

The guide plate 440 extends from the fixing plate 450 toward the printing media cassette 21.

The fixing plate 450 includes a plurality of fixing holes 451 to fix the fixing plate 450 in the apparatus body 10 and support protrusions 452 to support the first elastic member 430 and the second elastic member 480. Each support protrusion 452 is provided with a second support hole 452*a*. The other end 432 of the first elastic member 430 and the other end 482 of the second elastic member 480 are supported by the respective support protrusions 452 through the second support holes 452*a*.

Hereinafter, a process of opening and closing the printing media cassette 21 will be described.

FIGS. 15A to 15G are views showing a process of closing the printing media cassette.

Figure 15A:
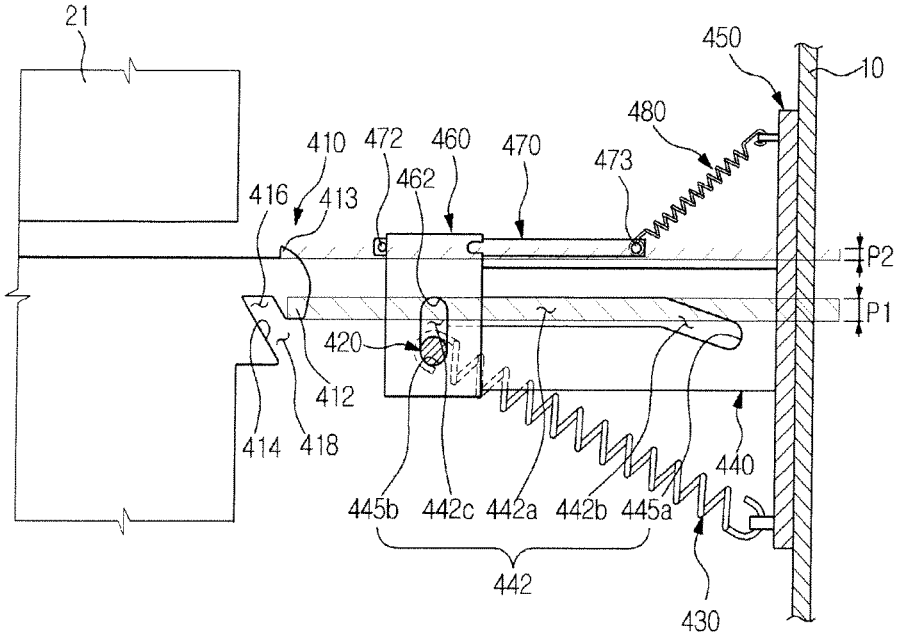
FIGS. 15A to 15G are views showing a process of closing the printing media cassette.
Figure 15B:
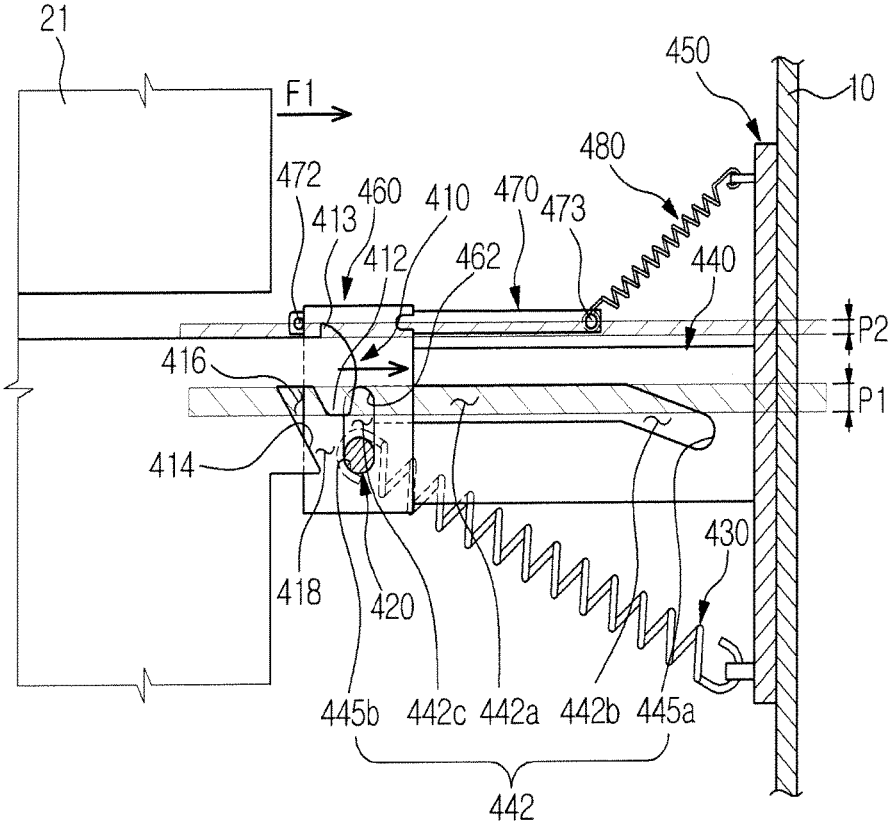
Figure 15C:
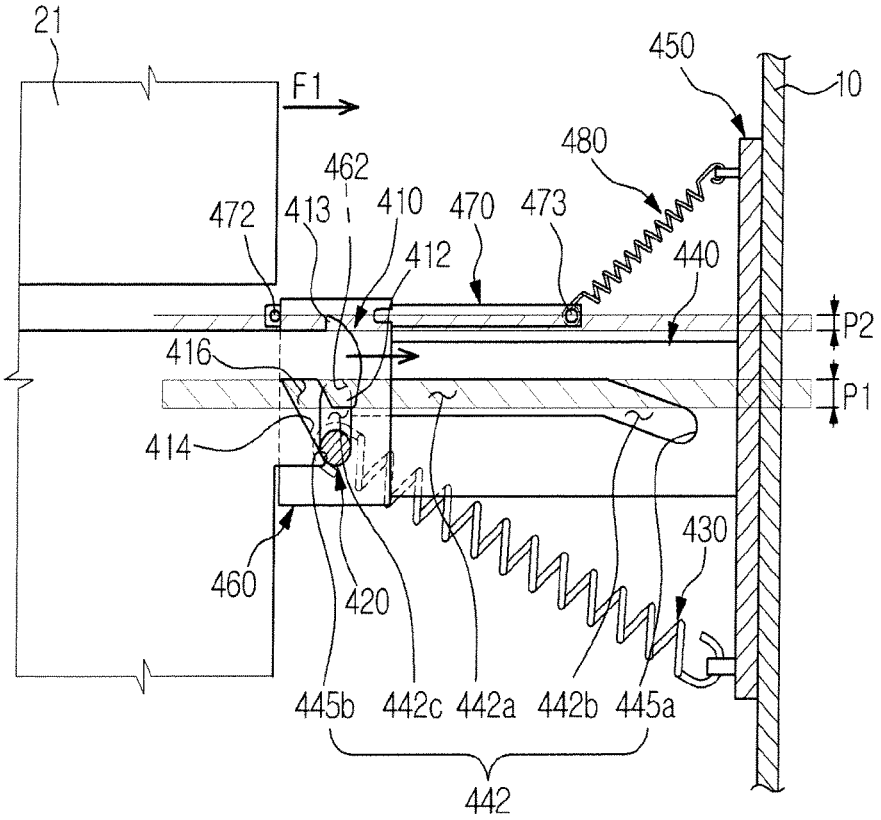
Figure 15D:
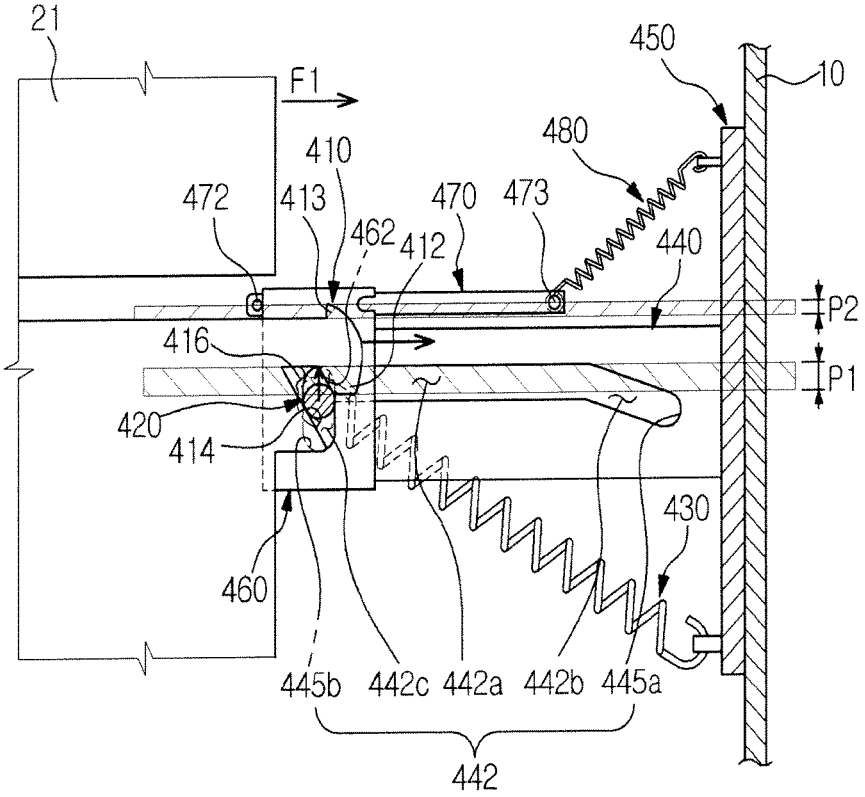
Figure 15E:
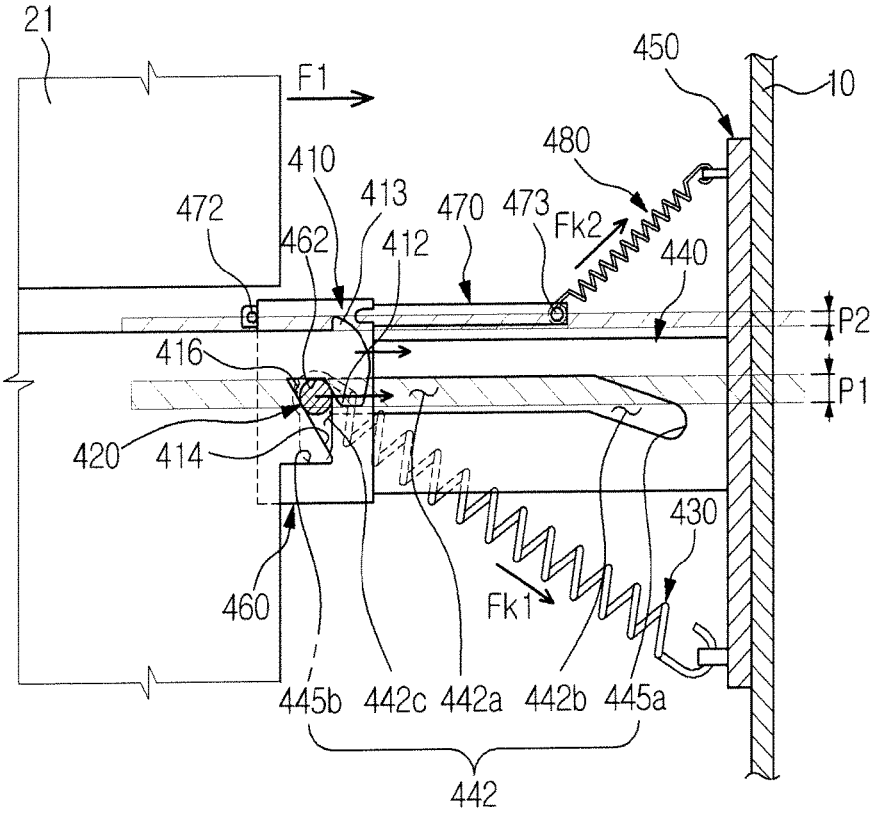

In a state in which the printing media cassette 21 is open, as shown in FIG. 15A, the second lever 420 of the opening and closing device 400 is located at the first position, i.e. the standby position. At this time, the second lever 420 is received in the second inclined part 442*c* of the first guide slot 442 and is supported and stopped by the second support part 445*b*. In a state in which the second lever 420 is located at the first position, the second lever 420 is located outside a movement path P2 of the second catching part 413 such that the second lever 420 does not interfere with the second catching part 413.

When the user applies force F1 to the printing media cassette 21, as shown in FIGS. 15B to 15E, the printing media cassette 21 enters the apparatus body 10. The second lever 420 is pushed by the guide part 414, is separated from the second inclined part 442*c*, and enters the parallel part 442*a*. At this time, the second lever 420 is received in the receiving groove 416 of the first lever 410 and contacts the first catching part 412.

Figure 15F:
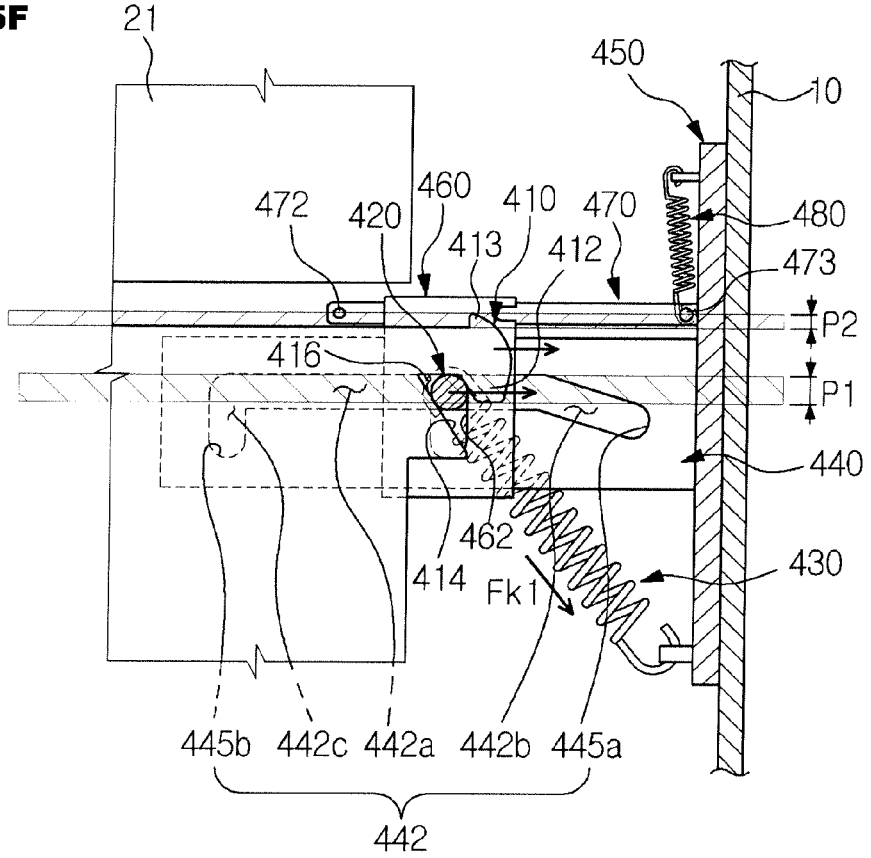

When the second lever 420 enters the parallel part 442*a*, as shown in FIG. 15F, the second lever 420 slides along the parallel part 442*a* and the first inclined part 442*b* due to elastic force Fk1 of the first elastic member 430 applied to the second lever 420. The slider 460 slides along the guide plate 440 in the direction in which the printing media cassette 21 is closed. At the same time, the connection lever 470 moves in the direction in which the printing media cassette 21 is closed due to elastic force Fk2 of the second elastic member 480. During slide movement of the second lever 420 along the parallel part 442*a* and the first inclined part 442*b*, the second lever 420 pushes the first lever 410 via the first catching part 412 to pull the printing media cassette 21 into the apparatus body 10. Consequently, the user may easily close the printing media cassette 21 using low force.

Figure 15G:
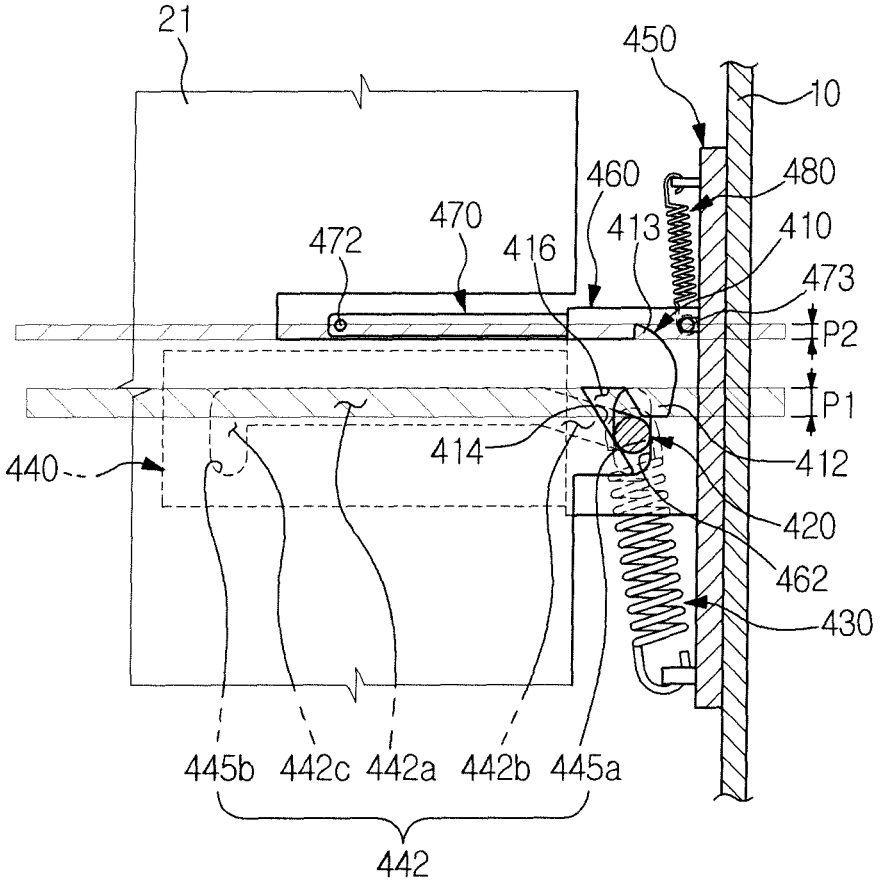

When the printing media cassette 21 is completely closed, as shown in FIG. 15G, the second lever 420 contacts the first support part 445*a* and is thus stopped and is located at the second position, i.e. the closed position. When the second lever 420 is stopped, the second lever 420 is separated from the first lever 410. That is, the second lever 420 is separated from the printing media cassette 21. The second catching protrusion 473 of the connection lever 470 is received in the protrusion receiving groove 466.

In a state in which the second lever 420 is located at the second position, the second lever 420 is located outside a movement path P1 of the first catching part 412 such that the second lever 420 does not interfere with the first catching part 412.

FIGS. 16A to 16H are views showing a process of opening the printing media cassette.

Figure 16A:
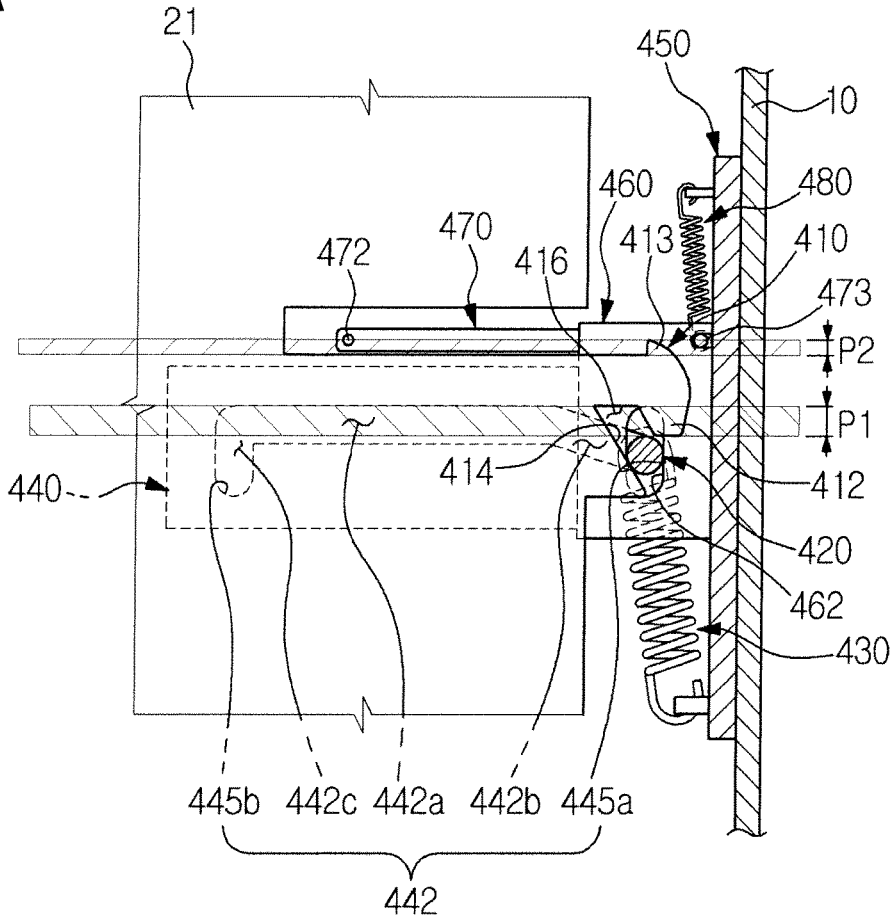
FIGS. 16A to 16H are views showing a process of opening the printing media cassette.
Figure 16B:
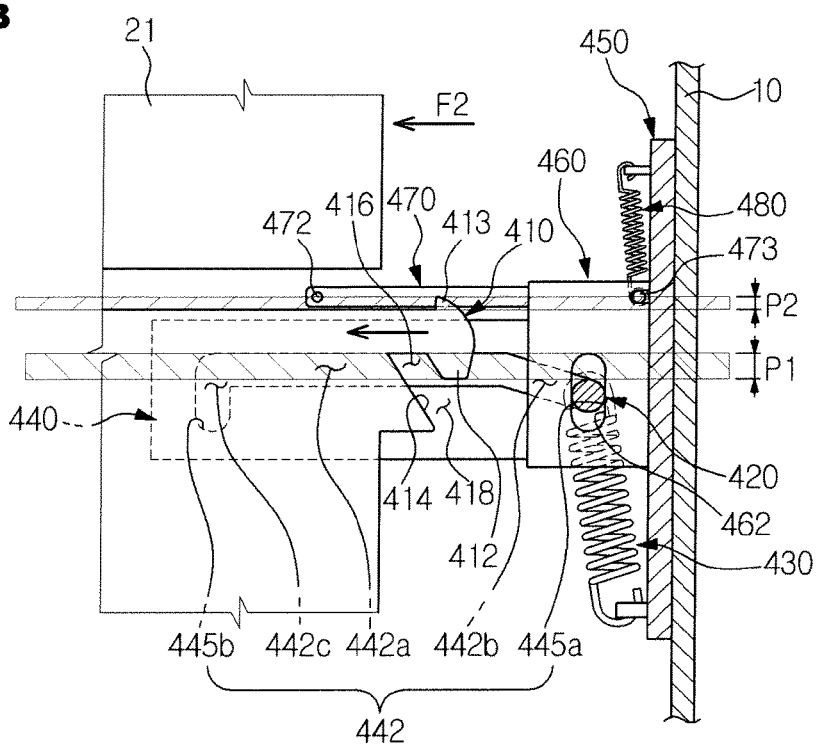

When the user applies force F2 to the printing media cassette 21 in a state in which the printing media cassette 21 is closed, as shown in FIGS. 16A and 16B, the printing media cassette 21 moves in the direction opposite to the direction in which the printing media cassette 21 enters the apparatus body 10. Since the second lever 420 is located outside the movement path P1 of the first catching part 412 such that the second lever 420 does not interfere with the first catching part 412, the second lever 420 is located and stopped at the second position. The printing media cassette 21 and the first lever 410 freely move without interference with the second lever 420. That is, any force from the opening and closing device 400 is not applied to the printing media cassette 21 excluding the force F2 applied by the user. Consequently, the user may pull the printing media cassette 21 from the apparatus body 10 using low force in a state in which the printing media cassette 21 is closed.

At this time, the slider 460, which receives the second lever 420, and the connection lever 470 also remain stopped. The second catching part 413 is located between the first catching protrusion 472 and the second catching protrusion 473 of the connection lever 470. The second catching part 413 gets away from the second catching protrusion 473 and gets near to the first catching protrusion 472 according to movement of the first lever 410.

Figure 16C:
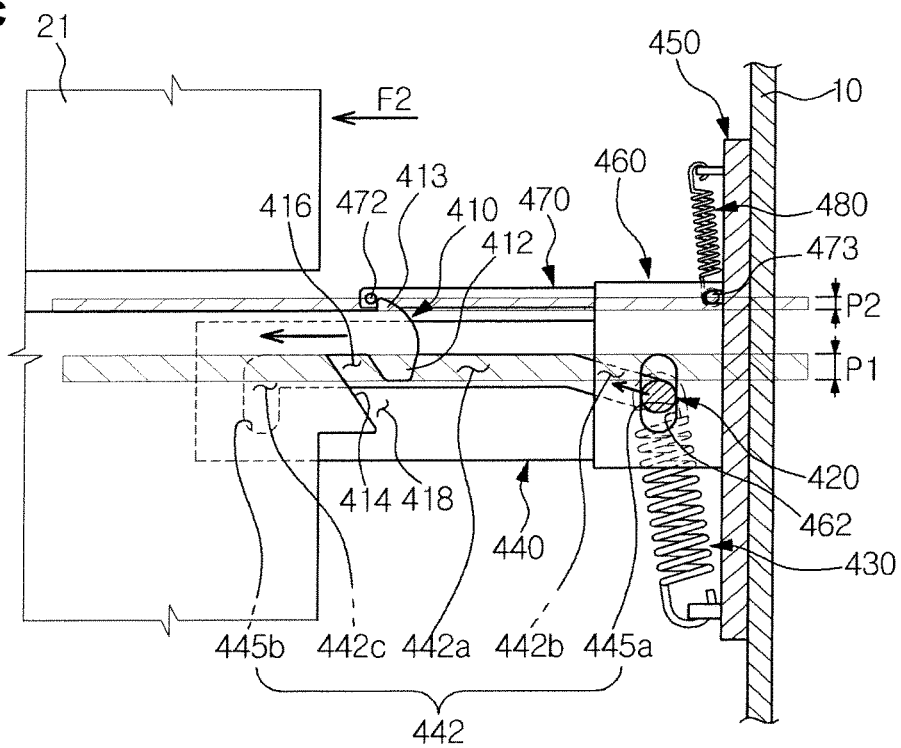
Figure 16D:
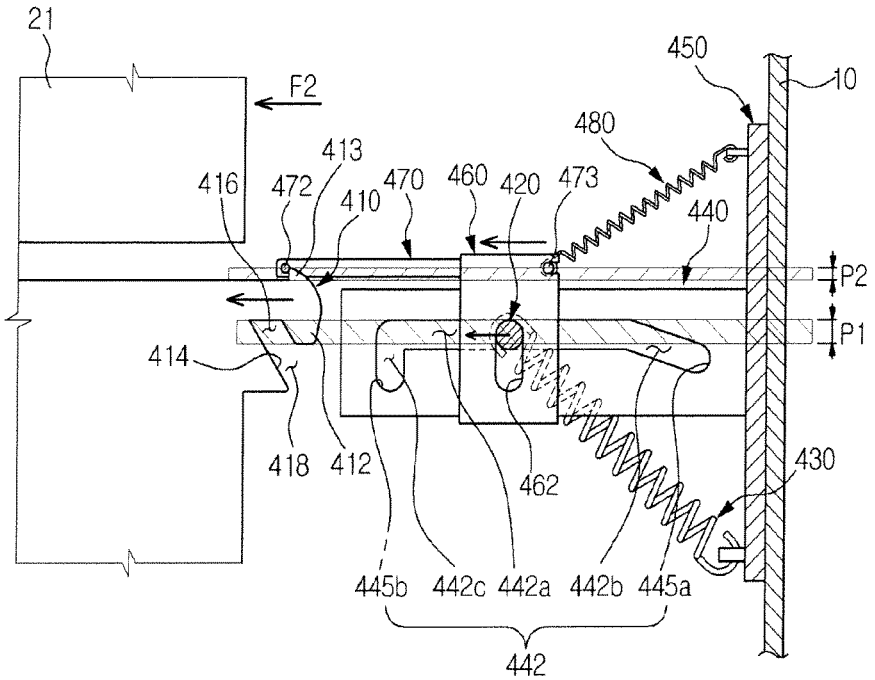
Figure 16E:
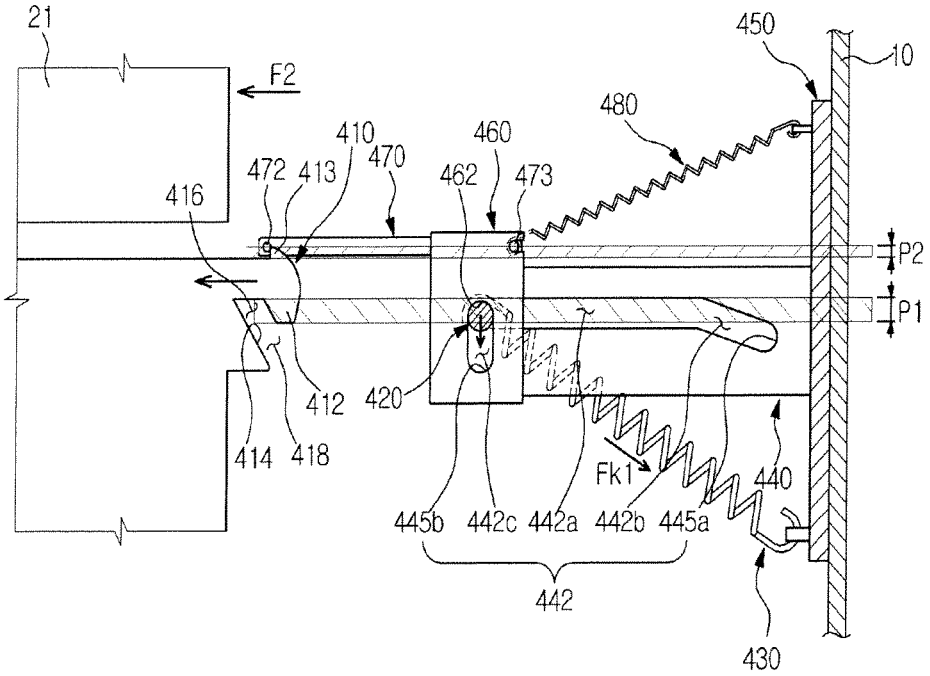
Figure 16F:
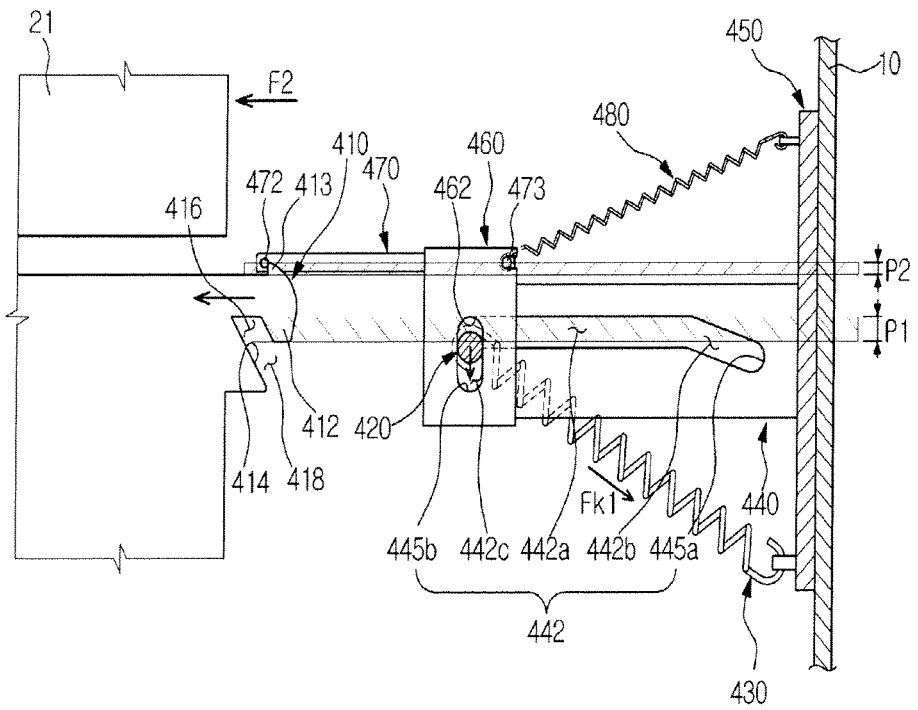
Figure 16G:
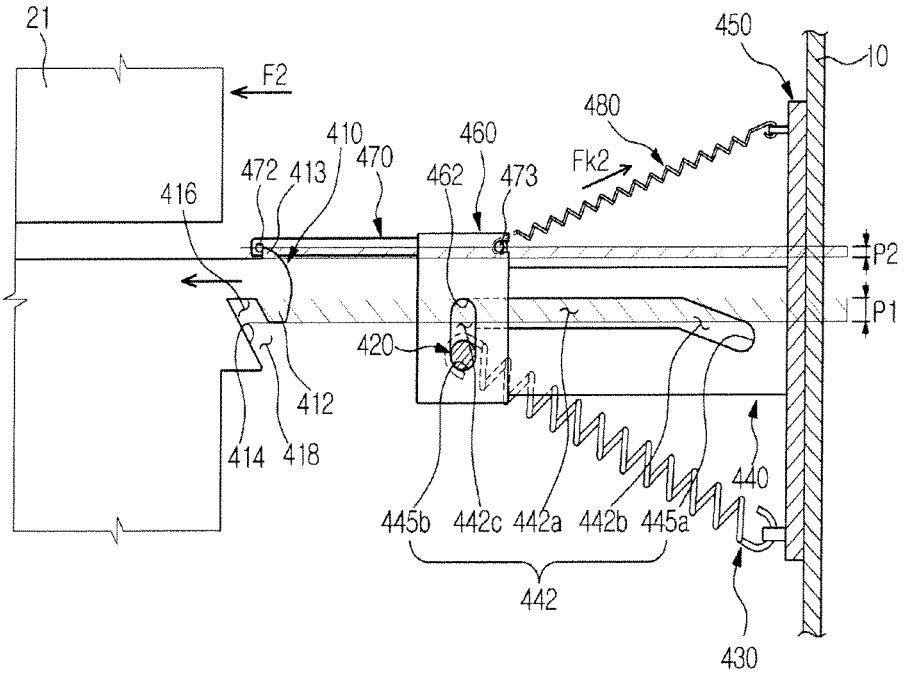
Figure 16H:
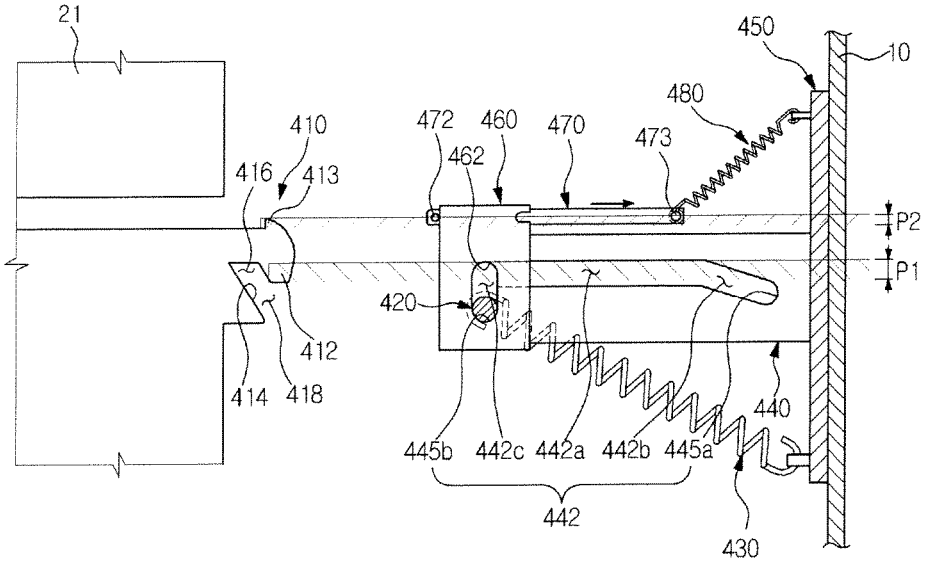

When the second catching part 413 of the first lever 410 contacts the first catching protrusion 472 of the connection lever 470, as shown in FIGS. 16C and 16D, the slider 460 is pushed by the second catching protrusion 473 received in the protrusion receiving groove 466 and slides along the guide plate 440 in the direction in which the printing media cassette 21 is opened. The second lever 420 is pushed by the slider 460 and slides along the first inclined part 442*b* and the parallel part 442*a*. The first elastic member 430 connected to the second lever 420 and the second elastic member 480 connected to the connection lever 470 are extended to accumulate elastic force.

The second catching part 413 of the first lever 410 is accelerated until the second catching part 413 contacts the first catching protrusion 472. The accelerated second catching part 413 contacts the first catching protrusion 472 to push the second lever 420 via the second catching protrusion 473 and the slider 460. Consequently, the user may pull the printing media cassette 21 using low force.

When the second lever 420 slides along the first inclined part 442*b* and the parallel part 442*a* and reaches the end of the parallel part 442*a*, as shown in FIGS. 16E to 16H, the second lever 420 enters the second inclined part 442*c* along the second guide slot 462 and is supported and stopped by the second support part 445*b*. The second lever 420 is located at the first position, i.e. the standby position, and the first lever 410 is separated from the first catching protrusion 472 of the connection lever 470.

The above-described processes are repeatedly performed to open and close the printing media cassette 21.

As is apparent from the above description, according to the embodiment of the present invention, the user may easily open and close the printing media cassette, thereby improving emotional quality of products and convenience in using the products.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. An image forming apparatus comprising:

an apparatus body;

a printing media cassette to receive printing media, the printing media cassette movably coupled to the apparatus body; and a lever movably disposed in the apparatus body, the lever to contact the printing media cassette to pull the printing media cassette into the apparatus body and to separate from the printing media cassette when the printing media cassette is fully closed.

2. The image forming apparatus according to claim 1, wherein the lever is slidably disposed along a movement path provided in the apparatus body.

3. The image forming apparatus according to claim 1, wherein, when the printing media cassette is fully closed, the lever is pushed by the printing media cassette and then pushes the printing media cassette.

4. The image forming apparatus according to claim 1, wherein, when the printing media cassette is opened, the printing media cassette moves to separate from the lever and to contact the lever to push the lever.

5. The image forming apparatus according to claim 1, wherein the printing media cassette comprises:

a first catching part pushed by the lever when the printing media cassette is fully closed; and a second catching part to push the lever when the printing media cassette is opened.

6. The image forming apparatus according to claim 5, wherein the printing media cassette further comprises a guide part to push the lever to guide the lever to the first catching part when the printing media cassette is fully closed.

7. The image forming apparatus according to claim 5, wherein the printing media cassette further comprises a lever receiving part receiving at least a portion of the lever when the printing media cassette is fully closed.

8. The image forming apparatus according to claim 1, further comprising an elastic member disposed between the apparatus body and the lever to elastically bias the lever.

9. The image forming apparatus according to claim 8, further comprising:

a fixing plate fixed in the apparatus body; and a guide plate extending from the fixing plate toward the printing media cassette, the guide plate comprising a guide slot to guide the lever.

10. The image forming apparatus according to claim 9, wherein the guide slot comprises:

a parallel part parallel to a movement direction of the printing media cassette; and a first inclined part and a second inclined part inclined from the parallel part.

11. The image forming apparatus according to claim 10, wherein the first inclined part is perpendicular to the parallel part.

12. The image forming apparatus according to claim 10, wherein, when the printing media cassette is fully closed, the lever pushes the printing media cassette after the lever enters the parallel part.

13. The image forming apparatus according to claim 9, wherein the lever comprises:

a catching pin contacting the printing media cassette when the printing media cassette is fully closed or opened; and a support pin coupled to the catching pin via the guide plate, the support pin having a first support hole to support one end of the elastic member.

14. The image forming apparatus according to claim 13, wherein the fixing plate comprises a support protrusion having a second support hole to support the other end of the elastic member.

15. The image forming apparatus according to claim 1, further comprising:

a fixing plate fixed in the apparatus body;

a guide plate extending from the fixing plate toward the printing media cassette, the guide plate having a first guide slot to guide the lever; and a slider slidably coupled to the guide plate, the slider having a second guide slot to guide the lever.

16. The image forming apparatus according to claim 15, wherein the second guide slot is perpendicular to a movement direction of the printing media cassette.

17. The image forming apparatus according to claim 15, further comprising at least one elastic member disposed between the fixing plate and the slider to elastically bias the slider.

18. The image forming apparatus according to claim 15, further comprising a connection lever movably coupled to the slider, the connection lever being connected to the printing media cassette when the printing media cassette is opened.

19. The image forming apparatus according to claim 18, wherein the connection lever comprises:

a first catching part contacting the printing media cassette and pushed by the printing media cassette when the printing media cassette is opened; and a second catching protrusion received in the slider to push the slider when the printing media cassette is opened.

20. The image forming apparatus according to claim 19, further comprising:

a first elastic member disposed between the fixing plate and the lever to elastically bias the lever; and a second elastic member disposed between the fixing plate and the connection lever to elastically bias the connection lever.

21. An image forming apparatus comprising:

an apparatus body;

a printing media cassette to receive printing media, the printing media cassette movably coupled to the apparatus body; and a lever slidably disposed along a movement path provided in the apparatus body, wherein when the printing media cassette is opened, the printing media cassette moves to separate from the lever and to contact the lever to push the lever along the movement path.

22. An image forming apparatus comprising:

an apparatus body;

a printing media cassette to receive printing media, the printing media cassette movably coupled to the apparatus body; and an opening and closing device pulling the printing media cassette into the apparatus body when the printing media cassette is fully closed, wherein the opening and closing device comprises:

a first catching part and a second catching part provided at the printing media cassette, the first catching part and the second catching part being spaced apart from each other; and a lever slidably disposed along a movement path provided in the apparatus body, the lever to contact one of the first and second catching parts when the printing media cassette is opened and to contact the other of the first and second catching parts when the printing media cassette is fully closed.

23. The image forming apparatus according to claim 22, wherein the opening and closing device further comprises a guide part connected to the first catching part, the guide part being inclined from a movement direction of the printing media cassette.

24. The image forming apparatus according to claim 23, wherein the lever is located at a first position in a state in which the printing media cassette is open and at a second position different from the first position in a state in which the printing media cassette is fully closed.

25. The image forming apparatus according to claim 24, wherein, in a state in which the lever is located at the first position, the lever is located outside a movement path of the second catching part such that the lever does not interfere with the second catching part.

26. The image forming apparatus according to claim 24, wherein, in a state in which the lever is located at the second position, the lever is located outside a movement path of the first catching part such that the lever does not interfere with the first catching part.

27. An image forming apparatus comprising:

an apparatus body;

a printing media cassette to receive printing media, the printing media cassette movably coupled to the apparatus body;

a first lever provided at the printing media cassette;

a second lever provided in the apparatus body; and at least one elastic member provided in the apparatus body to elastically bias the second lever, wherein when the printing media cassette is fully closed, the second lever pushes the first lever while sliding due to elastic force of the elastic member to pull the printing media cassette into the apparatus body and is then disposed such that the second lever does not interfere with the first lever, and when the printing media cassette is opened, the first lever moves through a predetermined initial section without interference with the second lever, pushes the second lever to slide the second lever, and is then separated from the second lever.

* * * * *